United States Patent [19]

Aoki et al.

[11] Patent Number: 4,971,898

[45] Date of Patent: Nov. 20, 1990

[54] SILVER HALIDE COLOR PHOTOGRAPHIC LIGHT-SENSITIVE MATERIAL

[75] Inventors: Kozo Aoki; Osamu Takahashi, both of Kanagawa, Japan

[73] Assignee: Fuji Photo Film Co., Ltd., Kanagawa, Japan

[21] Appl. No.: 321,949

[22] Filed: Mar. 10, 1989

[30] Foreign Application Priority Data

Mar. 10, 1988 [JP] Japan ..... 63-57305

[51] Int. Cl.[5] ..... G03C 7/34

[52] U.S. Cl. ..... 430/549; 430/553

[58] Field of Search ..... 430/549, 552, 553

[56] References Cited

U.S. PATENT DOCUMENTS

| | | | |
|---|---|---|---|
| 3,772,002 | 11/1973 | Ramello | 430/553 |
| 4,564,590 | 1/1986 | Sasaki et al. | 430/553 |
| 4,581,324 | 4/1986 | Wolff et al. | 430/553 |
| 4,686,177 | 8/1987 | Aoki et al. | 430/553 |
| 4,731,320 | 3/1988 | Sasaki et al. | 430/553 |
| 4,892,810 | 1/1990 | Aoki et al. | 430/552 |

*Primary Examiner*—Richard L. Schilling
*Attorney, Agent, or Firm*—Sughrue, Mion, Zinn, Macpeak & Seas

[57] ABSTRACT

A silver halide color photographic light-sensitive material comprising a support having provided thereon at least one silver halide emulsion layer, wherein the silver halide color photographic material contains at least one cyan coupler represented by the general formula (I) described below and at least one cyan coupler represented by the general formula (II) described below (I)

(II)

wherein $R_1$ represents an alkyl group having at least 8 carbon atoms; $R_2$ and $R_6$ each represents an alkyl group having from 2 to 4 carbon atoms; $R_3$ represents an alkyl group, an aryl group, a halogen atom, an alkoxy group, a hydroxy group, an acyloxy group or an alkoxycarbonyloxy group; n represents an integer from of 1 to 5, when n is 2 or more, two or more $R_3$'s are the same or different; $R_4$ represents a hydrogen atom or an alkyl group having not more than 16 carbon atoms; $R_5$ represents a hydrogen atom or an alkyl group having not more than 4 carbon atoms; m represents an integer of from 1 to 4; $X_1$ and $X_2$ each represents a hydrogen atom, a halogen atom, an alkyl group, an alkoxy group or an acylamino group; and $Z_1$ and $Z_2$ each represents a hydrogen atom or a group capable of being released upon a coupling reaction with a developing agent.

The silver halide color photographic material has a high dye forming rate and provides a high maximum color density even when a color developing solution which does not contain benzyl alcohol is used, exhibits substantially no reduction in color density in the case of processing in a bleaching solution having a weak oxidation power or an exhausted bleaching solution, and forms color images having excellent and well balanced fastness to heat and light.

23 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing at least two kinds of cyan dye forming couplers in combination.

BACKGROUND OF THE INVENTION

When color development processing is carried out after a silver halide photographic light-sensitive material is exposed to light, a developing agent, such as an aromatic primary amine, oxidized with silver halide reacts with a coupler to form a color image. In this process, color reproduction by a subtractive process is generally utilized. In accordance with this process, color images of yellow, magenta and cyan, which are complement colors of blue, green and red, respectively, are formed in order to reproduce images of blue, green and red.

Phenol derivatives or naphthol derivatives are mainly used as cyan color image forming couplers. However, the color images formed from conventionally employed phenol derivatives or naphthol derivatives have some problems with respect to preservability. For example, color images formed from the 2-acylaminophenol cyan couplers as described in U.S. Pat. Nos. 2,367,531, 2,369,929, 2,423,730 and 2,801,171 generally have inferior fastness to heat. Color images formed from the 2,5-diacylaminophenol cyan couplers as described in U.S. Pat. Nos. 2,772,162 and 2,895,826 generally have inferior fastness to light, and color images formed from 1-hydroxy-2-naphthamide cyan couplers generally have inferior fastness to both light and heat (particularly humidity and heat).

Further, 2-acylaminophenol cyan couplers and 1-hydroxy-2-naphthamide cyan couplers are defective in that the color density obtained therefrom severely decreases when processed with a bleaching solution having weak oxidizing power.

Cyan couplers derived from m-ethylphenols having an $\alpha$-phenoxyalkyl group as a ballast group as described in U.S. Pat. No. 2,772,002 exhibit remarkably improved heat fastness of color image and extremely small reduction in color density when processed with a bleaching solution having weak oxidizing power. However, these cyan couplers have a low color forming property and have a side effect of degradating light fastness of the color image.

On the other hand, cyan couplers derived from methylphenols having an alkyl group as a ballast group as described in U.S. Pat. No. 4,686,177 have a markedly high color forming property and are excellent in light fastness of the color image formed therefrom. However, the heat fastness of the color image and the decrease in color density when processed with a bleaching solution having a weak oxidizing power are inferior, as compared with the cyan couplers as described in U.S. Pat. No. 2,772,001 mentioned above.

SUMMARY OF THE INVENTION

It is an object of the present invention to provide a silver halide color photographic light-sensitive material which exhibits a sufficiently high dye forming rate and maximum color density in a color developing solution, particularly even in a color developing solution which does not contain benzyl alcohol.

Another object of the present invention is to provide a silver halide color photographic light-sensitive material which exhibits substantially no reduction in color density in the case of processing in a bleaching solution having weak oxidizing power, for example, a bleaching solution containing sodium salt of EDTA iron (III) or ammonium salt of EDTA iron (III), or an exhausted bleaching solution.

A further object of the present invention is to provide a silver halide color photographic light-sensitive material which forms color images having excellent fastness and in which heat fastness and light fastness are controlled in good balance.

Other objects of the present invention will become apparent from the following detailed description and examples.

The above described objects of the present invention can be accomplished by a silver halide color photographic light-sensitive material comprising a support having provided thereon at least one silver halide emulsion layer, wherein the silver halide color photographic material contains at least one cyan coupler represented by the general formula (I) described below and at least one cyan coupler represented by the general formula (II) described below:

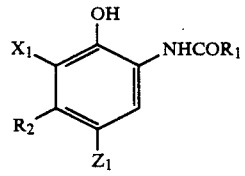

(I)

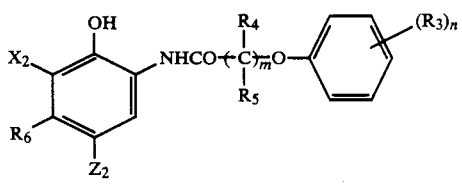

(II)

wherein $R_1$ represents an alkyl group having at least 8 carbon atoms; $R_2$ and $R_6$ each represents an alkyl group having from 2 to 4 carbon atoms; $R_3$ represents an alkyl group, an aryl group, a halogen atom, an alkoxy group, a hydroxy group, an acyloxy group or an alkoxycarbonyloxy group; n represents an integer of from 1 to 5, when n is 2 or more, two or more $R_3$'s are the same or different; $R_4$ represents a hydrogen atom or an alkyl group having not more than 16 carbon atoms; $R_5$ represents a hydrogen atom or an alkyl group having not more than 4 carbon atoms; m represents an integer of from 1 to 4; $X_1$ and $X_2$ each represents a hydrogen atom, a halogen atom, an alkyl group, an alkoxy group or an acylamino group; and $Z_1$ and $Z_2$ each represents a hydrogen atom or an atom or a group capable of being released upon a coupling reaction with a developing agent.

DETAILED DESCRIPTION OF THE INVENTION $R_1$, $R_2$, $R_3$, $R_4$, $R_5$, $R_6$, $X_1$, $X_2$, $Z_1$ and $Z_2$ in the above general formula (I) or (II) will now be described in greater detail below.

In the present invention an alkyl group and an aryl group include a substituted and unsubstituted alkyl and aryl groups, and alkyl group may be straight chain, branched chain or cyclic form. Furthermore, groups which may be aliphatic or aromatic include both of aliphatic groups and aromatic groups.

In the general formula (I), $R_1$ represents an alkyl group having at least 8 carbon atoms (in the alkyl moiety). Specific examples thereof include octyl, tridecyl, pentadecyl, heptadecyl, eicosyl, iso-pentadecyl, or 4-tert-butylcyclohexyl.

In the general formulae (I) and (II), $R_2$ and $R_6$ each represents an alkyl group having from 2 to 4 carbon atoms. Specific examples thereof include ethyl, propyl, butyl, iso-propyl, or tert-butyl.

In the general formula (II), $R_3$ represents an alkyl group preferably having not more than 20 carbon atoms (for example, methyl, butyl, octyl, pentadecyl, tert-butyl, tert-pentyl, tert-octyl, cyclohexyl, or 1-methyl-1-phenylethyl), and aryl group (for example, phenyl), a halogen atom (for example, fluorine, chlorine, or bromine), an alkoxy group (for example, methoxy, butoxy, or dodecyloxy), a hydroxy group, an acyloxy group (for example, acetoxy, benzoyloxy, or octanoyloxy), or an alkoxycarbonyloxy group (for example, methoxycarbonyloxy, 2-ethylhexyloxycarbonyloxy, or hexadecyloxycarbonyloxy).

In the general formula (II), $R_4$ represents a hydrogen atom or an alkyl group having not more than 16 carbon atoms (for example, methyl, ethyl, butyl, octyl, dodecyl, hexadecyl, or cyclohexyl).

In the general formula (II), $R_5$ represents a hydrogen atom or an alkyl group having not more than 4 carbon atoms (for example, methyl, ethyl, butyl, or isopropyl).

In the general formulae (I) and (II), $X_1$ and $X_2$ each represents a hydrogen atom, a halogen atom (for example, fluorine, chlorine, or bromine), an alkyl group (for example, methyl, propyl, or octyl), an alkoxy group (for example, methoxy, or butoxy), or an acylamino group (for example, acetylamino, or benzoylamino).

In the general formulae (I) and (II), $Z_1$ and $Z_2$ each represents a hydrogen atom or an atom or a group capable of being released upon coupling (hereinafter such an atom and a group is referred to as a group capable of being released upon coupling). Examples of the groups capable of being releasing upon coupling include a halogen atom (for example, fluorine, chlorine, or bromine), an alkoxy group (for example, ethoxy, dodecyloxy, methoxycarbamoylmethoxy, carboxypropyloxy, or methylsulfonylethoxy), an aryloxy group (for example, 4-chlorophenoxy, 4-methoxyphenoxy, or 4-carboxyphenoxy), an acyloxy group (for example, acetoxy, tetradecanoyloxy, or benzoyloxy), a sulfonyloxy group (for example, methanesulfonyloxy, or toluenesulfonyloxy), an amido group (for example, dichloroacetylamino, butyrylamino, methanesulfonylamino, or toluenesulfonylamino), an alkoxycarbonyloxy group (for example, ethoxycarbonyloxy, or benzyloxycarbonyloxy), an aryloxycarbonyloxy group (for example, phenoxycarbonyloxy), an aliphatic or aromatic thio group (for example, ethylthio, phenylthio, or tetrazolylthio), an imido group (for example, a succinimido, or hydantoinyl), an N-heterocyclic group preferably a 5- to 7-membered ring containing an N atom or further containing at least one of N, O and S atoms (for example, 1-pyrazolyl, or 1-benzotriazolyl), and an aromatic azo group (for example, phenylazo). These groups may contain a photographically useful group such as a group which forms, for example, a development inhibitor, a development accelarator or a brightening agent.

Of the groups described above, those which can be substituted are substituted with one or more substituents selected from an alkyl group, an aryl group, an alkoxy or aryloxy group (for example, methoxy, dodecyloxy, methoxyethoxy, phenoxy, 2,4-di-tert-amylphenoxy, 3-tert-butyl-4-hydroxyphenoxy, or naphthyloxy), —COOM and —$SO_3M$ (wherein M represents H, alkali metal atom such as Na, K and Li, or $NH_4$), an alkylcarbonyl or arylcarbonyl group (for example, acetyl, tetradecanoyl, or benzoyl), an alkoxycarbonyl or aryloxycarbonyl group (for example, methoxycarbonyl, benzyloxycarbonyl, or phenoxycarbonyl), an acyloxy group (for example, acetoxy, benzoyloxy, or phenylcarbonyloxy), a sulfamoyl group (for example, N-ethylsulfamoyl, or N-octadecylsulfamoyl), a carbamoyl group (for example, N-ethylcarbamoyl, or N-methyldodecylcarbamoy), a sulfonamido group (for example, methanesulfonamido, or benzenesulfonamido), an acylamino group (for example, acetylamino, benzamido, ethoxycarbonylamino, or phenylaminocarbonylamino), an imido group (for example, succinimido, or hydrantoinyl), a sulfonyl group, (for example, methanesulfonyl), a hydroxy group, a cyano group, a nitro group and a halogen atom.

In the general formulae (I) and (II), $X_1$ and $X_2$ each preferably represents a halogen atom, and particularly preferably a fluorine atom or a chlorine atom.

In the general formula (II), $R_5$ is preferably a hydrogen atom.

In the general formula (II), m is preferably 1.

In the general formula (II), n is preferably 1 or 2.

In the general formulae (I) and (II), $Z_1$ and $Z_2$ each preferably represents a hydrogen atom or a halogen atom, more preferably a halogen atom, and particularly preferably a fluorine atom or a chlorine atom.

In the general formulae (I) and (II), $R_3$ preferably represents an alkyl group, a halogen atom, an alkoxy group, or a hydroxy group.

In the general formulae (I) and (II), $R_2$ and $R_6$ each preferably represents an ethyl group.

In the general formula (I), the number of carbon atoms included in $R_1$ is preferably from 8 to 21 and more preferably from 13 to 17.

In the general formula (I), $R_1$ is preferably a straight chain alkyl group.

In the general formula (II), $R_4$ is preferably an alkyl group having not more than 12 carbon atoms, and it is particularly preferred that $R_5$ is a hydrogen atom and m is 1.

In the general formula (II), when m is 2 or more, $R_4$ and $R_5$ are preferably hydrogen atoms respectively, and in this case it is particularly preferred that m is 3.

The coupler represented by the general formula (I) or (II) preferably has a ballast group which renders the coupler and the dye obtained therefrom non-diffusible in a hydrophilic colloid layer.

In the general formula (II)

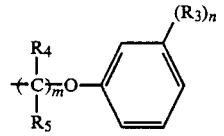

is preferably a ballast group which renders the coupler non-diffusible in a hydrophilic colloid.

Suitable examples of the cyan couplers represented by the general formula (I) are specifically set forth below, but the present invention should not be construed as being limited thereto.

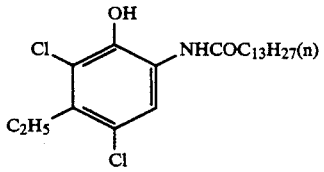
(I-1)

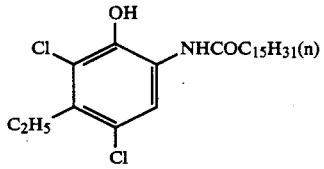
(I-2)

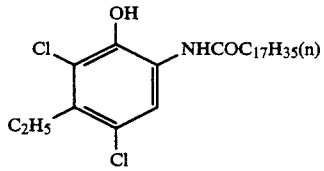
(I-3)

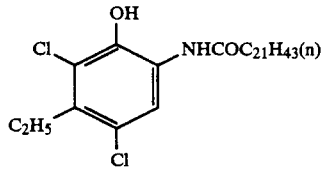
(I-4)

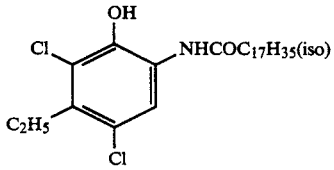
(I-5)

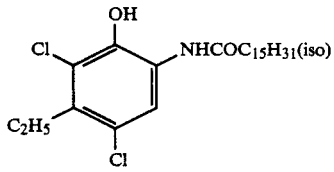
(I-6)

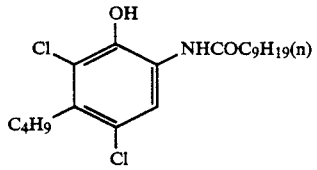
(I-7)

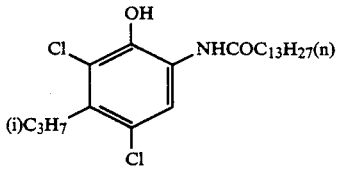
(I-8)

-continued

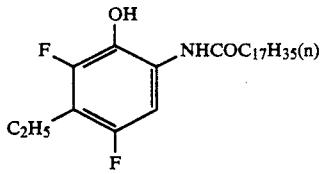
(I-9)

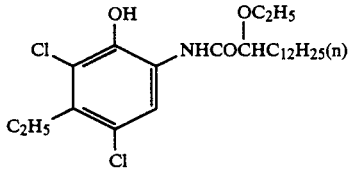
(I-10)

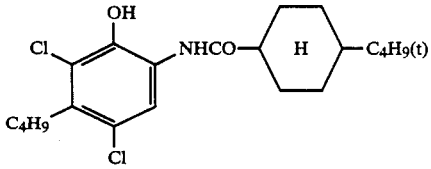
(I-11)

The cyan couplers represented by the general formula (I) can be synthesized by the method described in JP-A-61-39045 (the term "JP-A" as used herein means an "unexamined published Japanese patent application") (corresponding to U.S. Pat. No. 4,686,177) or in a similar manner thereto.

Suitable examples of the cyan couplers represented by the general formula (II) are specifically set forth below, but the present invention should not be construed as being limited thereto.

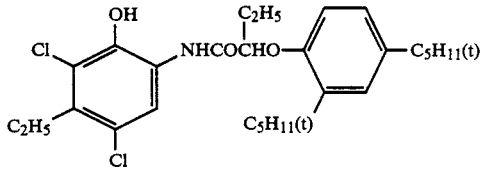
(II-1)

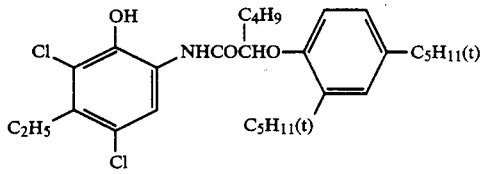
(II-2)

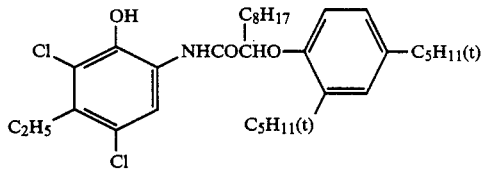
(II-3)

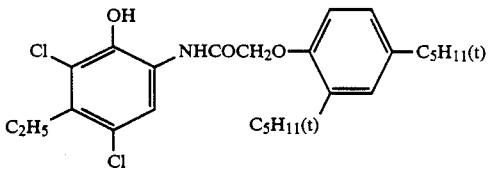
(II-4)

-continued
(II-5)
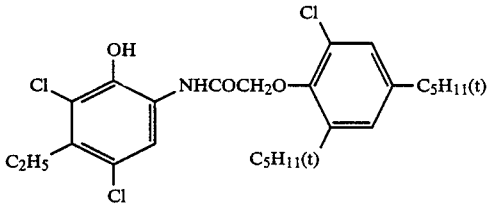
(II-6)
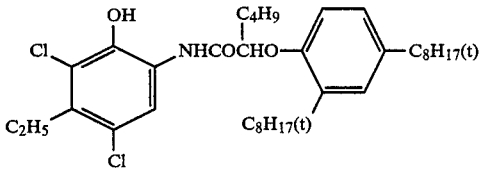
(II-7)
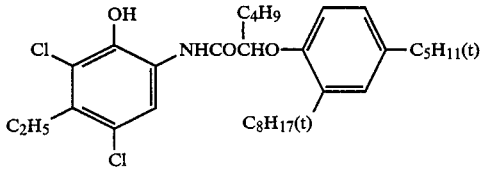
(II-8)
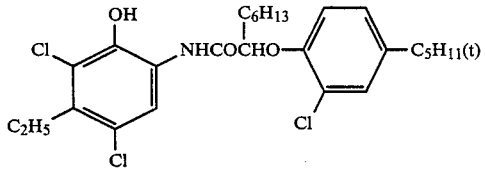
(II-9)
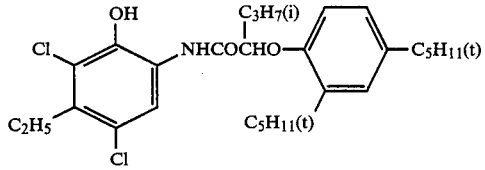
(II-10)
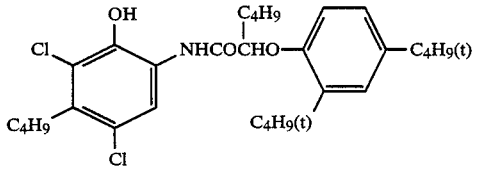
(II-11)
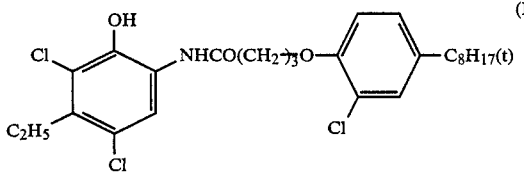
(II-12)
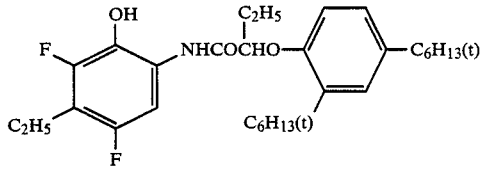
-continued
(II-13)
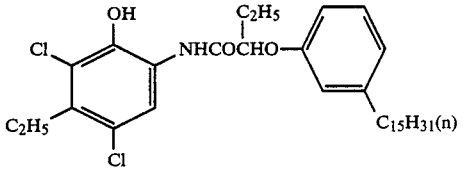
(II-14)
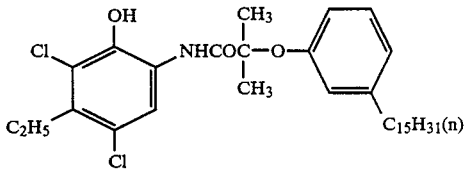
(II-15)
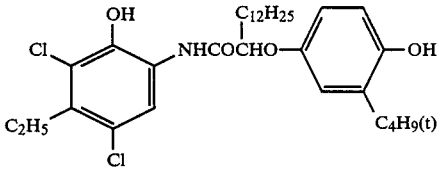
(II-16)
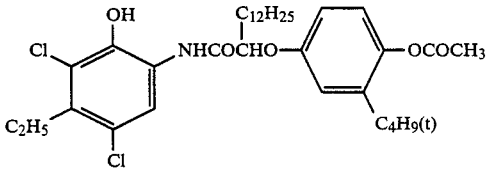
(II-17)
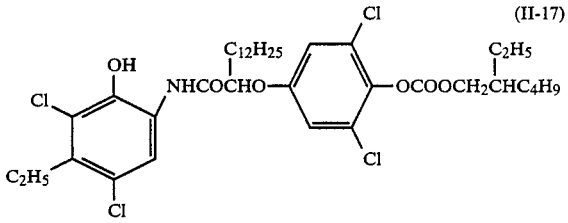
(II-18)
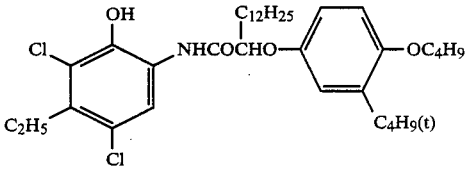
(II-19)
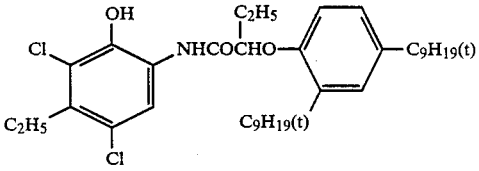
(II-20)
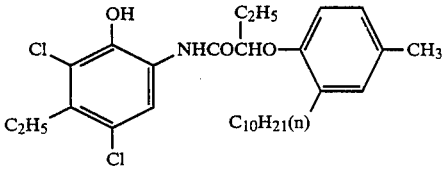
The cyan couplers represented by the general formula (II) can be synthesized by the method as described in U.S. Pat. No. 3,772,002 and JP-A-60-232550 or in a similar manner thereto.

In the present invention the cyan coupler represented by general formula (I) and the cyan coupler represented by general formula (II) is generally employed at a molar ratio ranging from 0.05 to 20, preferably from 0.2 to 5 and more preferably from 0.5 to 2.

The total amount of these cyan couplers employed is suitably from 0.1 mol to 1 mol, preferably from 0.2 mol to 0.5 mol per mol of silver.

It is preferable to incorporate these cyan couplers into a red-sensitive silver halide emulsion layer. The coupler represented by the general formula (I) and the coupler represented by the general formula (II) may be incorporated to the same emulsion layer or they may be incorporated to different emulsion layers separately.

The silver halide color photographic material according to the present invention may comprise a green-sensitive layer and a blue-sensitive layer in addition to the red-sensitive layer, and in these layers, a magenta coupler and a yellow coupler which form magenta and yellow colors upon coupling with an oxidation product of an aromatic amine type color developing agent, respectively, are usually, employed.

The coupler represented by the general formula (I) or (II) can be used with couplers which are conventionally used, such as, a phenol type cyan coupler having an acylamino group at the 2-position and a methyl group at the 5-position and a phenol type coupler having a carbostyril type condensed ring.

Suitable magenta couplers for use in the present invention, include oil protected indazolone type couplers and cyanoacetyl type couplers, preferably 5-pyrazolone type couplers and pyrazoloazole type couplers such as pyrazolotriazoles. 5-pyrazolone type couplers substituted with an arylamino group or an acylamino group at the 3-position thereof are preferred in view of hue and color density of the dyes formed. Typical examples thereof are described in U.S. Pat. Nos. 2,311,082, 2,343,703, 2,600,788, 2,908,573, 3,062,653, 3,152,896, and 3,936,015. Two-equivalent pyrazolone type couplers containing nitrogen atom-releasing groups as described in U.S. Pat. No. 4,310,619 and arylthio groups as described in U.S. Pat. No. 4,351,897, are preferred as releasing groups. Further, 5-pyrazolone type couplers having a ballast group as described in European Patent No. 73,636 are advantageous because they provide high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* No. 24220 (June, 1984), and pyrazolopyrazoles as described in *Research Disclosure,* No. 24230 (June, 1984). The above described couplers may be in the form of polymer couplers.

These compounds are specifically represented by the following general formula (M-1), (M-2) or (M-3):

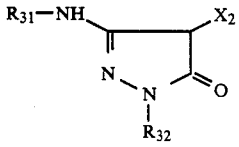
(M-1)

-continued

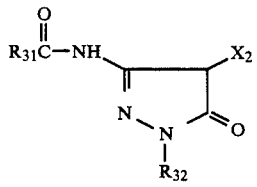
(M-2)

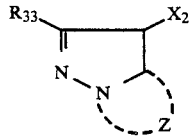
(M-3)

wherein $R_{31}$ represents a diffusion resistant group having from 8 to 32 carbon atoms in total; $R_{32}$ represents a phenyl group or a substituted phenyl group; $R_{33}$ represents a hydrogen atom or a substituent; Z represents a non-metallic atomic group necessary to form a 5-membered azole ring containing two to four nitrogen atoms, which azole ring may have one or more substituents (including a condensed ring); and $X_2$ represents a hydrogen atom or a group capable of being released.

The substituents for $R_{33}$ and the substituents on the azole ring are described in detail in U.S. Pat. No. 4,540,654, column 2, line 41 to column 8, line 27.

Among the pyrazoloazole type couplers, imidazo[1,2-b]pyrazoles as described in U.S. Pat. No. 4,500,630 are preferred, and pyrazolo[1,5-b][1,2,4]triazoles as described in U.S. Pat. No. 4,540,654 are particularly preferred in view of less yellow subsidiary absorption, and light fastness of the dyes formed.

In addition, pyrazolotriazole couplers wherein a branched chain alkyl group is directly connected to the 2-, 3- or 6-position of the pyrazolotriazole ring as described in JP-A-61-65245, pyrazoloazole couplers containing a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6-position as described in European Patent Application (published) Nos. 226,849, and 249,785 are preferably employed.

Preferred yellow couplers for use in the present invention, include acrylacetamide derivatives such as benzoylacetanilides and pivaloylacetanilides.

Among them, those represented by the general formula (Y-1) or (Y-2) shown below are more preferred as yellow couplers.

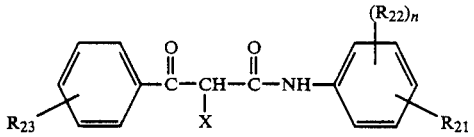
(Y-1)

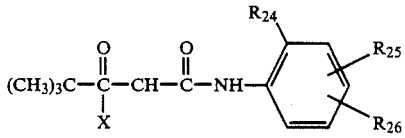
(Y-2)

wherein X represents a hydrogen atom or a group capable of being released upon coupling; $R_{21}$ represents a diffusion resistant group having from 8 to 32 carbon atoms in total; $R_{22}$ represents a halogen atom, a lower alkyl group, a lower alkoxy group or a diffusion resistant group having from 8 to 32 carbon atoms in total; $R_{23}$ represents a hydrogen atom or a substituent, when two or more $R_{23}$'s are present, they may be the same or different; $R_{24}$ represents a halogen atom, an alkoxy group, a trifluoromethyl group or an aryl group; $R_{25}$ represents a hydrogen atom, a halogen atom or an alkoxy group; $R_{26}$ represents $—NHCOR_{27}$, $—NHSO_2R_{27}$, $—SO_2NHR_{27}$, $—COOR_{27}$, and $$—SO_2\underset{\underset{R_{28}}{|}}{N}R_{27}$$

(wherein $R_{27}$; and $R_{28}$ each represents an alkyl group, an aryl group or an acyl group); and n represents 0 or an integer of from 1 to 4.

The pivaloylacetanilide type yellow couplers are described in detail in U.S. Pat. No. 4,622,287, column 3, line 15 to column 8, line 39 and U.S. Pat. No. 4,623,616, column 14, line 50 to column 19, line 41.

The benzoylacetanilide type yellow couplers are described in detail in U.S. Pat. Nos. 3,408,194, 3,933,501, 4,046,575, 4,133,958 and 4,401,752.

Specific examples of the magenta couplers and yellow couplers which can be used in the green-sensitive layer and the blue-sensitive layer of the present invention, respectively, are set forth below, but the present invention should not be construed as being limited thereto.

Magenta Coupler:
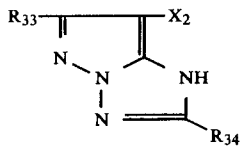
| Compound | $R_{33}$ | $R_{34}$ | $X_2$ |
|---|---|---|---|
| M-1 | $CH_3$— | 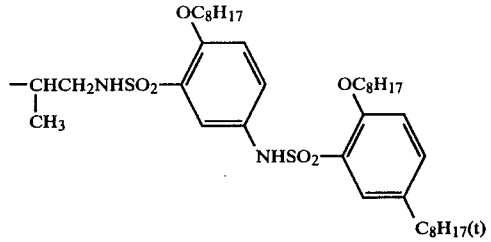 | Cl |
| M-2 | $CH_3$— | 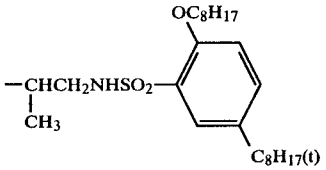 | Cl |
| M-3 | $CH_3$— | 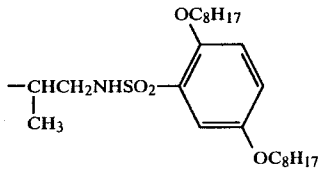 | 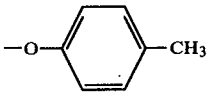 |
| M-4 | 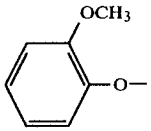 | 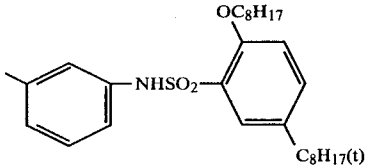 | 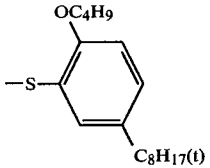 |

-continued
| | | | |
|---|---|---|---|
| M-5 | $CH_3$— | 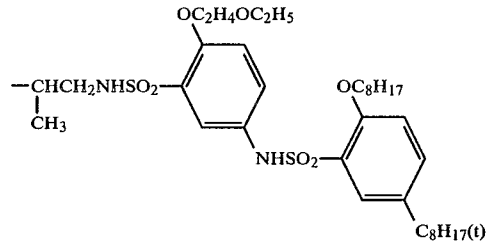 | Cl |
| M-6 | $CH_3$— | 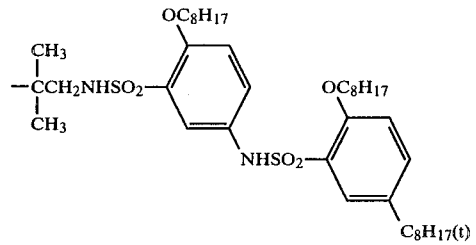 | Cl |
| M-7 | 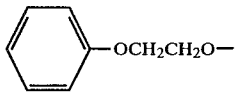 | 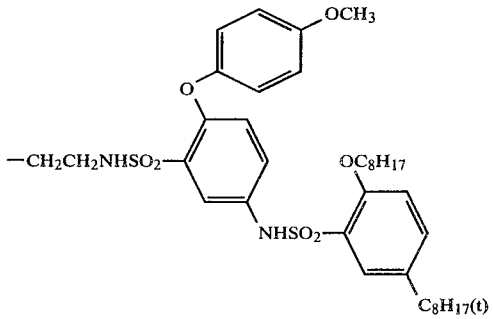 | 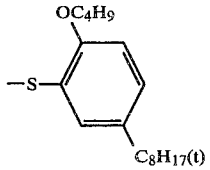 |

-continued
| | | | |
|---|---|---|---|
| M-8 | $CH_3CH_2O-$ | 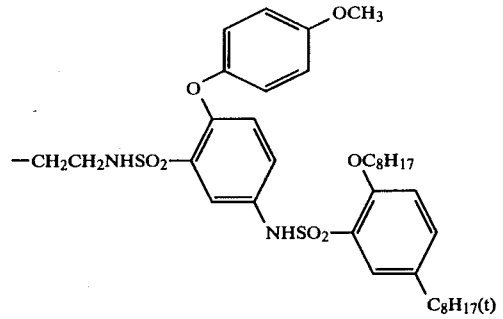 | 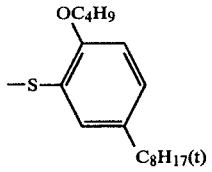 |
| M-9 | 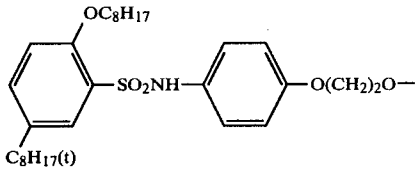 | 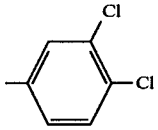 | 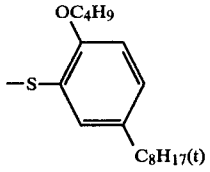 |
| M-10 | 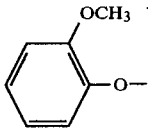 | 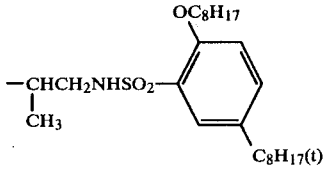 | Cl |
| M-11 | $CH_3-$ | 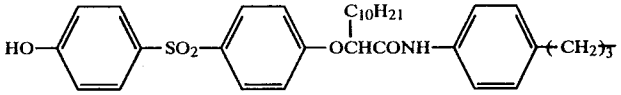 | Cl |
| M-12 | $CH_3-$ | 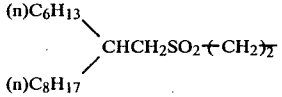 | Cl |

-continued
| | | | |
|---|---|---|---|
| M-13 | 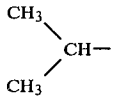 | 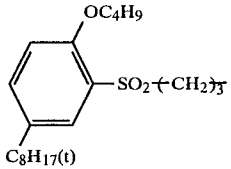 | Cl |
| M-14 | 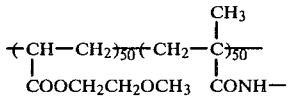 | 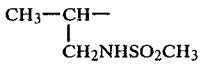 | Cl |
| M-15 | 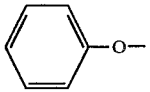 | 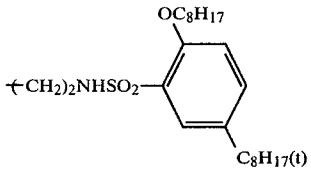 | Cl |
| M-16 | 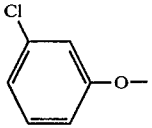 | 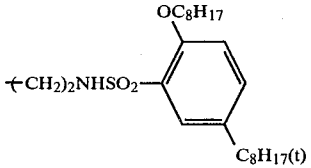 | 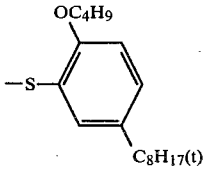 |
| (M-17) | 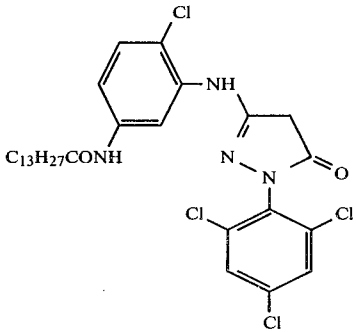 | | |

-continued
(M-18)
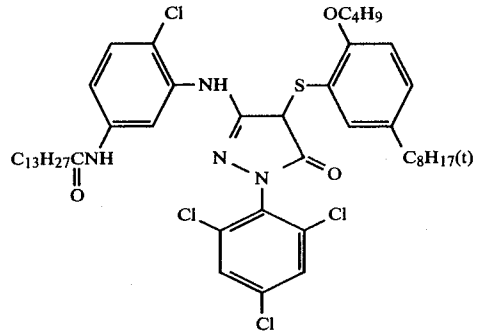
(M-19)
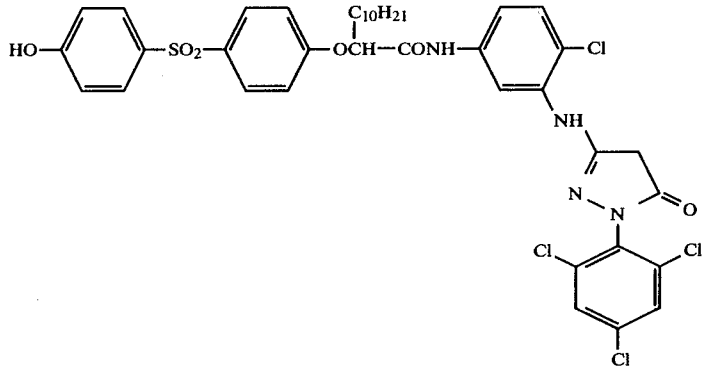
(M-20)
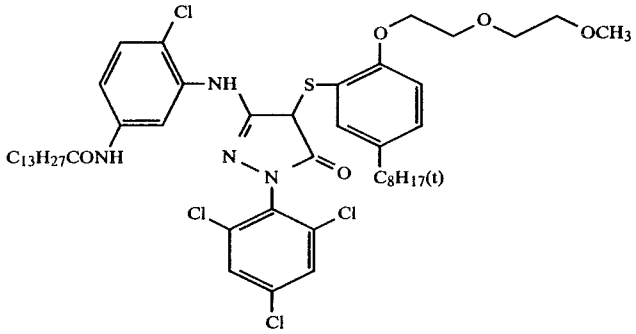

-continued
(M-21)
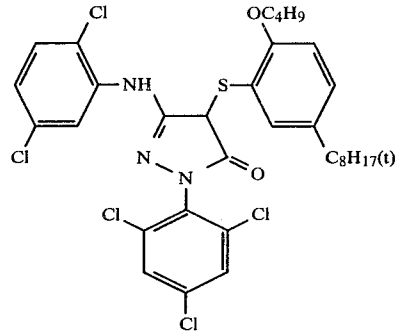
(M-22)
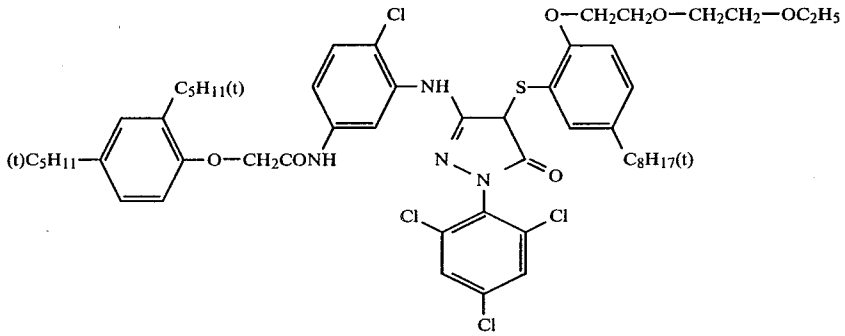
(M-23)
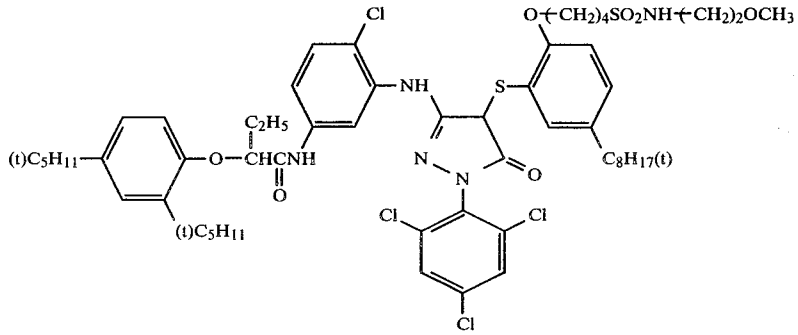

-continued
(M-24)
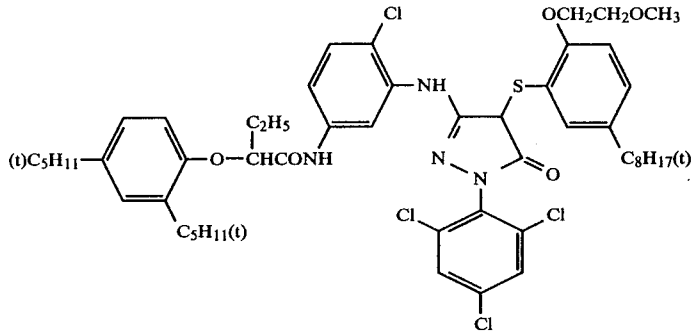
(M-25)
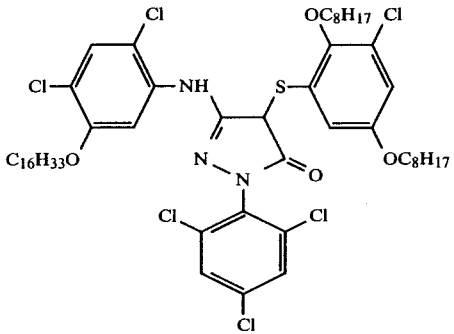
(M-26)
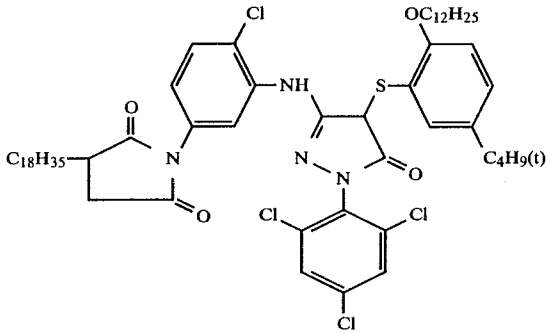

-continued
(M-27)
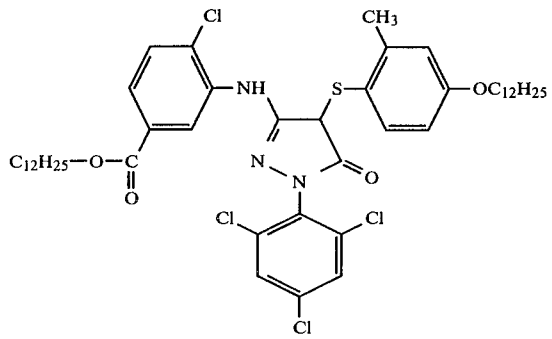
(M-28)
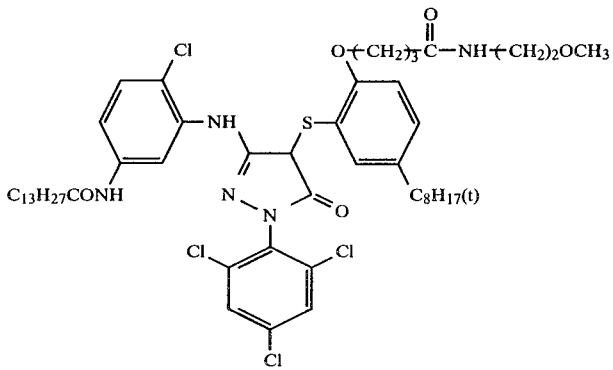

-continued
(M-29)
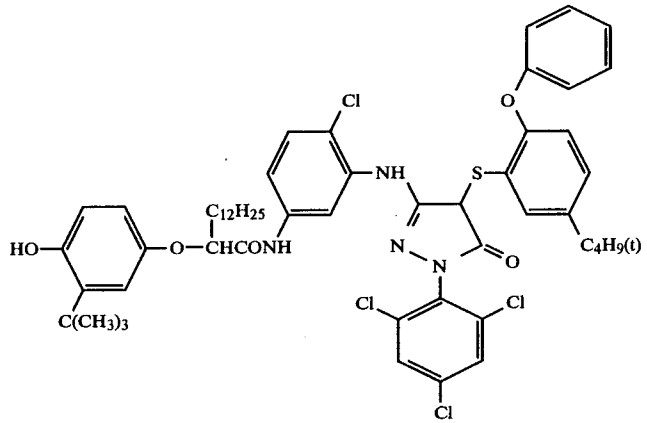
(M-30)
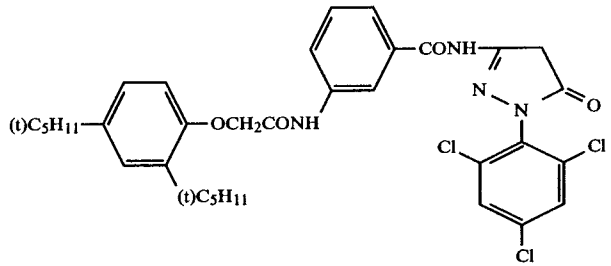
(M-31)
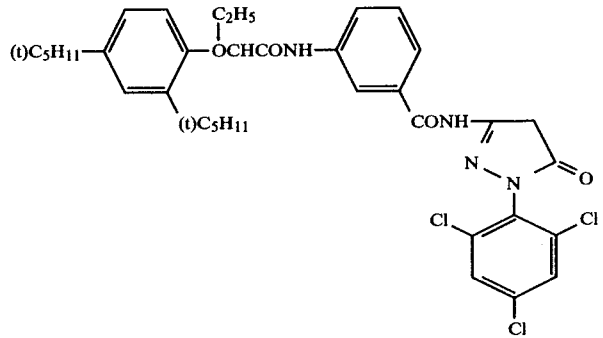

-continued
(M-32)
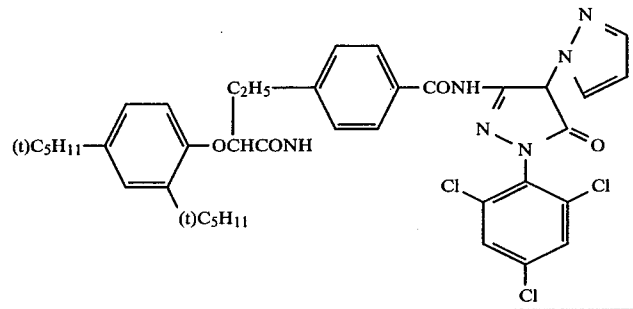

Yellow Coupler:
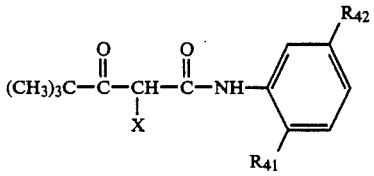
| Compound | $R_{42}$ | X | $R_{41}$ |
|---|---|---|---|
| Y-1 | $-COOCH(CH_3)COOC_{12}H_{25}$ | 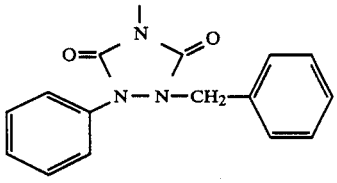 | Cl |
| Y-2 | $-COOCH(C_4H_9)COOC_{12}H_{25}$ | 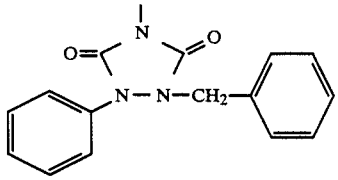 | Cl |
| Y-3 | 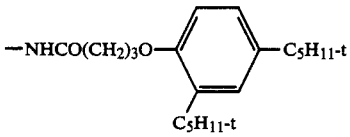 | 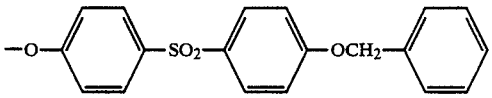 | Cl |
| Y-4 | 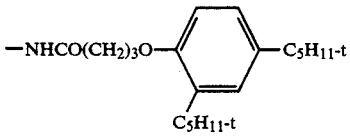 | 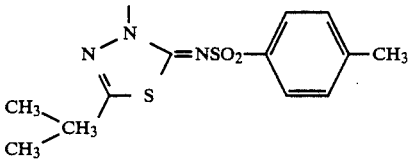 | Cl |
| Y-5 | 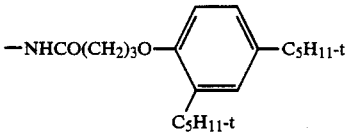 | 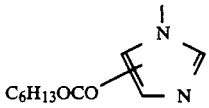 | Cl |
| Y-6 | $-NHSO_2C_{12}H_{25}$ | 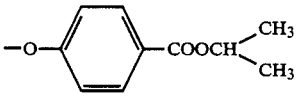 | Cl |
| Y-7 | $-NHSO_2C_{16}H_{33}$ | 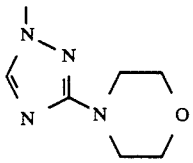 | Cl |

-continued
Yellow Coupler:
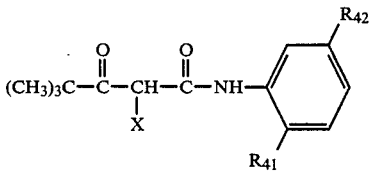
| Compound | $R_{42}$ | X | $R_{41}$ |
|---|---|---|---|
| Y-8 | $-COOC_{12}H_{25}(n)$ | 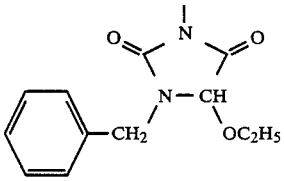 | Cl |
| Y-9 | 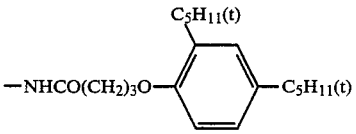 | 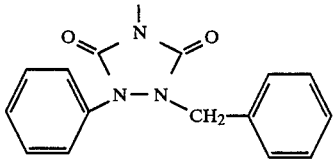 | Cl |
| Y-10 | 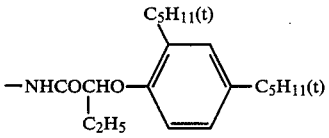 | 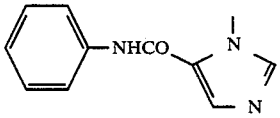 | $OCH_3$ |
| Y-11 | 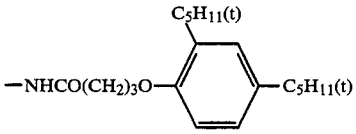 | 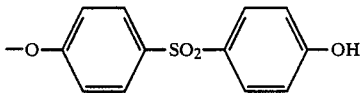 | Cl |
| Y-12 | 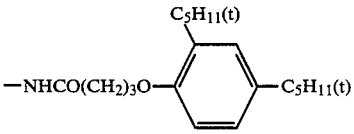 | 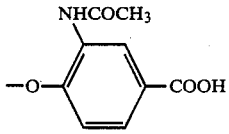 | Cl |
| Y-13 | 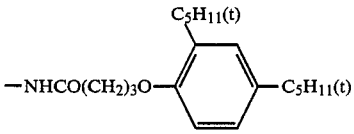 | 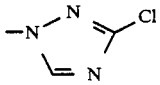 | Cl |
| Y-14 | 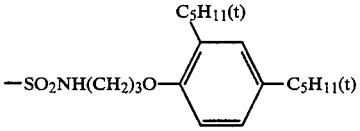 | 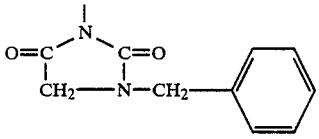 | Cl |
| Y-15 | 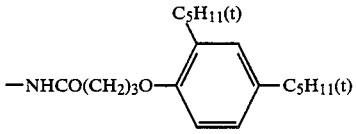 | 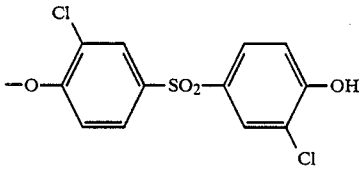 | Cl |

-continued
Yellow Coupler:
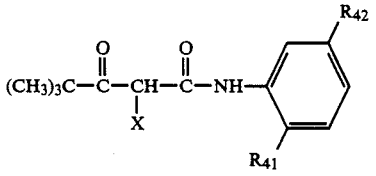
| Compound | $R_{42}$ | X | $R_{41}$ |
|---|---|---|---|
| Y-16 | 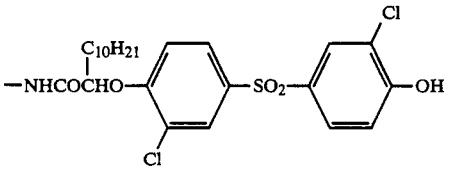 | 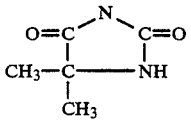 | Cl |
| Y-17 | 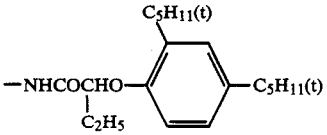 | 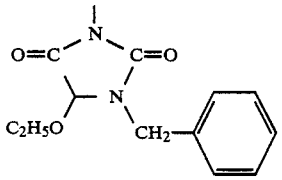 | Cl |
| Y-18 | 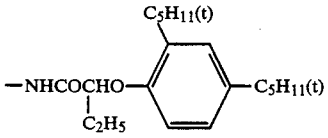 | 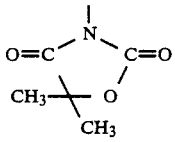 | Cl |
| Y-19 | $-NHSO_2C_{16}H_{33}$ | 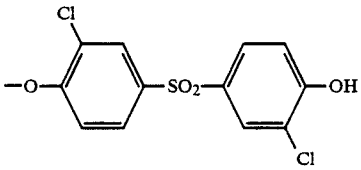 | Cl |
| Y-20 | 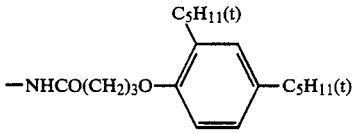 | 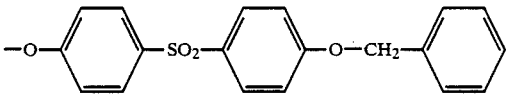 | Cl |
| Y-21 | 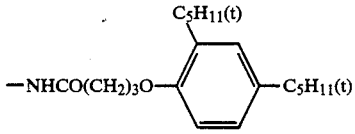 | 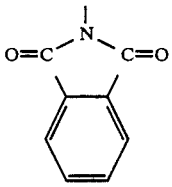 | Cl |
| Y-22 | 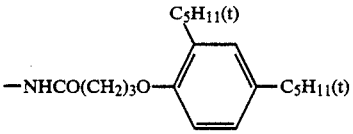 | 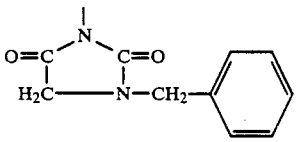 | Cl |

-continued
Yellow Coupler:
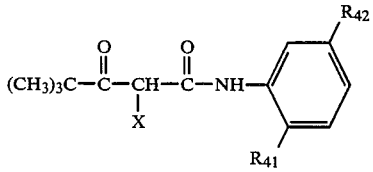
| Compound | $R_{42}$ | X | $R_{41}$ |
|---|---|---|---|
| Y-23 | $-NHCOCH(C_{16}H_{33})SO_3H$ | 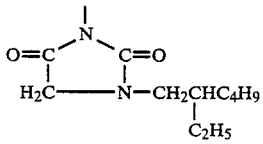 | Cl |
| Y-24 | 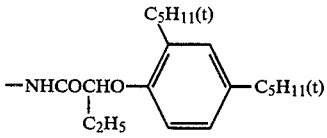 | 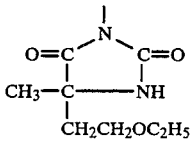 | Cl |
| Y-25 | $-NHCO(CH_3)CHCH_2SO_2C_{12}H_{25}(n)$ | 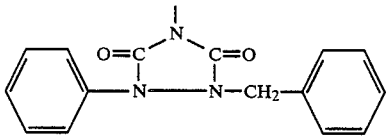 | Cl |
| Y-26 | $-NHSO_2C_{16}H_{33}(n)$ | 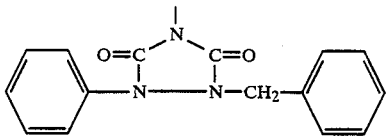 | Cl |
| Y-27 | 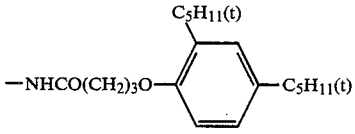 | 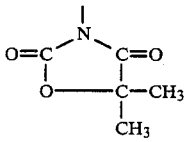 | Cl |
| Y-28 | 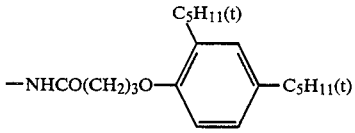 | 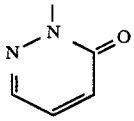 | Cl |
| Y-29 | Same as above | 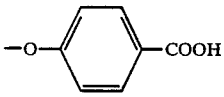 | Cl |
| Y-30 | $-NHSO_2-C_{16}H_{33}(n)$ | 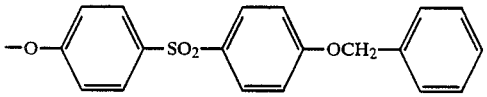 | Cl |
| Y-31 | $-NHSO_2-C_{16}H_{33}(n)$ | 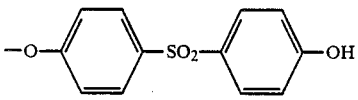 | Cl |

-continued

Yellow Coupler:

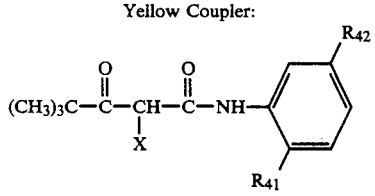

| Compound | $R_{42}$ | X | $R_{41}$ |
|---|---|---|---|
| Y-32 | $-SO_2-NHCH_3$ | 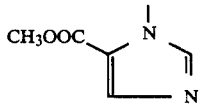 | $-OC_{16}H_{33}$ |
| Y-33 | 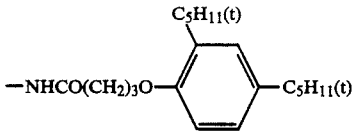 | 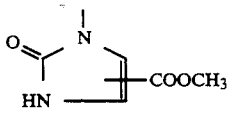 | Cl |
| Y-34 | 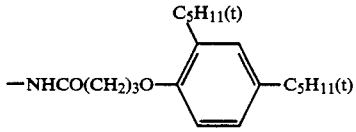 | 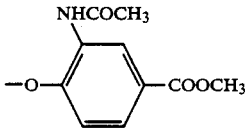 | Cl |
| Y-35 | 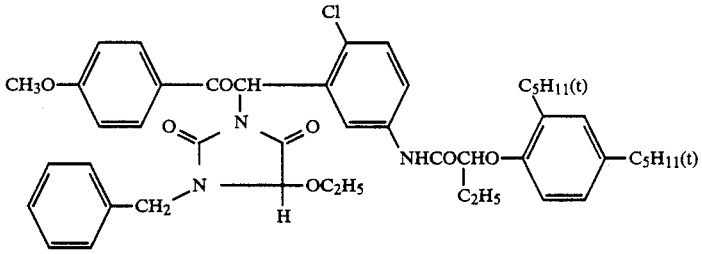 | | |
| Y-36 | 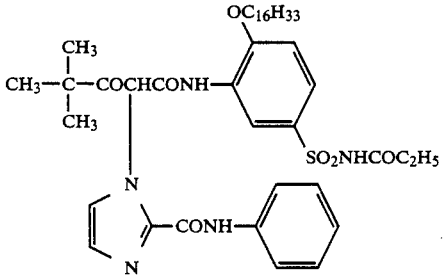 | | |

The magenta coupler and the yellow coupler according to the present invention are suitably used in an amount of from 0.1 mol to 1 mol, preferably from 0.2 mol to 0.5 mol, per mol of silver halide, respectively.

The couplers for use in the present invention are preferably incorporated into a silver halide emulsion as a dispersion of oleophilic fine particles.

The dispersion of oleophilic fine particles containing the couplers can be prepared in the following manner.

A coupler solvent having a high boiling point and the coupler are completely dissolved together with an auxiliary organic solvent. The solution is dispersed in water, preferably in an aqueous solution of a hydrophilic colloid, and more preferably in an aqueous solution of gelatin, with the assistance of a dispersant using ultrasonic agitation, or a colloid mill to form fine particles. Then, the dispersion is mixed with a silver halide emulsion.

Alternatively, water or an aqueous solution of a hydrophilic colloid such as an aqueous solution of gelatin is added to an auxiliary organic solvent containing a dispersant such as a surface active agent, a coupler solvent having a high boiling point and the coupler to prepare an oil droplet-in-water type dispersion accompanied by phase inversion.

Further, the dispersion prepared may be mixed with a photographic emulsion after removing the auxiliary organic solvent therefrom by an appropriate method such as distillation, noodle washing or ultrafiltration.

The term "auxiliary organic solvent" as used herein means an organic solvent which is useful in forming an emulsified dispersion, which is finally removed substantially from the photographic light-sensitive material during the drying step after coating or by the above-described method, and which is an organic solvent having a low boiling point, or a solvent having a certain extent of solubility in water and removable by washing with water.

Specific examples of auxiliary organic solvents include a lower alkyl acetate such as ethyl acetate, or butyl acetate, ethyl propionate, sec-butyl alcohol, methyl ethyl ketone, methyl isobutyl ketone, β-ethoxyethyl acetate, methyl cellosolve acetate, and cyclohexanone.

Further, an organic solvent which is fully miscible with water, for example, methyl alcohol, ethyl alcohol, acetone, or tetrahydrofuran may be partially employed together, if desired.

Two or more such organic solvents can be employed in combination.

The average particle size of the oleophilic fine particles thus prepared is preferably from 0.04 μm to 2 μm, more preferably from 0.06 μm to 0.4 μm. The particle size of the oleophilic fine particles can be determined using an appropriate measuring apparatus, for example, Nanosizer (manufactured by Coalter Co., England).

When the couplers represented by the general formula (I) and the couplers represented by the general formula (II) are used in the same silver halide emulsion layer they may be incorporated to the emulsion after forming separate dispersion for each coupler or after coemulsifying to form a dispersion.

Alternatively, these couplers may be emulsified to a hydrophilic colloid aqueous solution after being impregnated to a loadable latex polymer (described, for example, in U.S. Pat. No. 4,203,716) using or not using of a high boiling point organic solvent or after being dissolved in a water insoluble and organic solvent soluble polymer. Homopolymers and copolymers disclosed in WO88/00723, pages 12 to 30 may be used for this purpose. From the point of view of color image stabilization it is particularly preferable to use an acrylamide polymer.

Suitable examples of the above described coupler solvent having a high boiling point used in the present invention include those represented by the following general formula (XXIII), (XXIV), (XXV), (XXVI)), (XXVII) or (XXVIII):

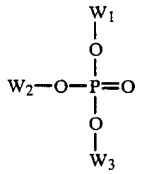
(XXIII)

$W_1—COOW_2$ (XXIV)

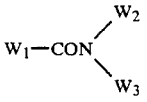
(XXV)

-continued

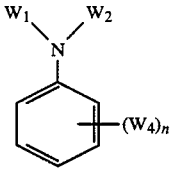
(XXVI)

$W_1—O—W_2$ (XXVII)

$HO—W_6$ (XXVIII)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, $—O—W_1$ or $—S—W_1$; n represents an integer of from 1 to 5, and when n is two or more, two or more $W_4$'s are the same or different; $W_1$ and $W_2$ in the general formula (XXVII) may combine with each other to form a condensed ring; $W_6$ represents a substituted or unsubstituted alkyl group or a substituted or unsubstituted aryl group and the total number of carbon atoms included in $W_6$ is not less than 12.

Suitable coupler solvents for use in the present invention, also include compounds which have a melting point of 100° C. or lower and a boiling point of 140° C. or higher and which are immiscible with water and are good solvents for the coupler, may be utilized. The melting point of the coupler solvent having a high boiling point is preferably not more than 80° C. The boiling point of the coupler solvent having a high boiling point is preferably not less than 160° C., more preferably not more than 170° C.

When the melting point of the coupler solvent used exceeds about 100° C., crystallization of couplers is apt to occur and the improving effect on the color forming property tends to decrease.

Suitable surface active agents include anionic surface active agents such as alkylbenzenesulfonic acids or alkylnaphthalenesulfonic acid and/or nonionic surface active agents such as sorbitol sesquioleate or sorbitol monolaurate. In the color photographic material according to the present invention, any of silver bromide, silver iodobromide, silver iodochlorobromide, silver chlorobromide, and silver chloride can be used as the silver halide.

In particular, for the purpose of conducting a rapid processing, silver chlorobromide containing 90 mol % or more, more preferably 98 to 99.9 mol % of silver chloride is preferred. Although such silver chlorobromide may contain a slight amount of silver iodide, it is preferred that it does not contain silver iodide at all.

There is no particular restriction on the average grain size (the grain size being defined as the diameter of the grains when the grain has a spherical or a nearly spherical form, and as the length of the edge when the grain has a cubic form, and being averaged based on projected area of the grains) of the silver halide grains in the photographic emulsions but it is preferred that the grain size be not more than 2 μm, and particularly from 0.2 μm to 1.5 μm.

The silver halide grains in the photographic emulsion layer may have a regular crystal form (regular crystal form emulsion) such as cubic, tetradecahedral, octahedral, etc., or an irregular crystal form such as spherical, tabular, etc., or may have a composite form of these crystal forms. Also, a mixture of grains having various crystal forms may be used. Of these emulsions, the use of a photographic emulsion of regular crystal form is preferred.

Further, a silver halide emulsion wherein tabular silver halide grains having a diameter/thickness ratio of at least 5 accounts for at least 50% of the total projected area of the silver halide grains, may be used in the present invention.

A silver halide emulsion employed in at least one layer of the light-sensitive layers is preferably a monodispersed silver halide emulsion having a coefficient of variation (a value which is obtained by dividing a statistical standard deviation of the silver halide grain size distribution with an average grain size and is indicated in terms of a percent) of not more than 15%, more preferably not more than 10%.

Such a monodispersed emulsion may be a single emulsion having the coefficient of variation described above, or an emulsion composed of a mixture of two or more kinds of monodispersed emulsions prepared separately and having different average grain sizes and each having a coefficient of variation of not more than 15%, and preferably not more than 10%. In the latter case, the coefficient of variation of the mixed emulsion may be more than or less than 15%. The difference in grain size and the mixing ratio of these monodispersed emulsions to be mixed can be appropriately selected. However, emulsions having a difference in average grain size ranging from not less than 0.2 μm to not more than 1.0 μm are preferably employed.

The coefficient of variation and the methods of measurement therefor are described in T. H. James, *The Theory of The Photoqraphic Process*, Third Edition, page 39, The Macmillan Company (1966).

The silver halide grains used in the present invention may have different phase between the inside and the surface layer thereof. Also, the silver halide grains may be of the type that latent images are formed mainly on the surface thereof or of the type that latent images are formed mainly in the interior thereof. The latter type grains are particularly useful for direct positive emulsions.

During the formation or physical ripening of the silver halide grains, a cadmium salt, a zinc salt, a thallium salt, a lead salt, an iridium salt or a complex salt thereof, a rhodium salt or a complex salt thereof, an iron salt or a complex salt thereof, etc., may coexist in the system.

Silver halide emulsions are usually chemically sensitized. Conventional chemical sensitization methods can be applied. The details of such methods are described in JP-A-62-215272, page 12, from the left lower column, line 18 to the right lower column, line 16.

Further, silver halide emulsions are usually spectrally sensitized. Methine dyes are ordinarily employed for the spectral sensitization. Details of the above are described in JP-A-62-215272, from page 22, right upper column, line 3 from the bottom to page 38 and Attachment B to the Amendment therefor filed Mar. 16, 1987.

The silver halide emulsions used in the present invention can contain various kinds of compounds for preventing the occurrence of fog or for stabilizing photographic performance during the production, sotrage and/or photographic processing of color photographic materials. Examples of such compounds include many compounds known as antifoggants or stabilizers such as azoles (for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercapto-tetrazoles (in particular, 1-phenyl-5-mercaptotetrazole, etc.), mercaptopyrimidines, mercaptotriazines, etc.; thioketo compounds such as oxazolinethione, etc.; azaindenes (for example, triazaindenes, tetraazaindenes (in particular, 4-hydroxysubstituted 1,3,3a,7-tetraazaindene), pentaazaindenes, etc.; benzenethiosulfonic acid, benzenesulfinic acid, benzenesulfonic acid amide, etc.

The color photographic light-sensitive material according to the present invention may contain a hydroquinone derivative, an aminophenol derivative, an amine, a gallic acid derivative, a catechol derivative, an ascorbic acid derivative, a non-color-forming coupler, or a sulfonamidophenol derivative, as a color fog preventing agent or a color mixing preventing agent.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxycoumarans, spirochromans, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes represented by (bissalicylaldoxymato) nickel complex and (bis-N,N-dialkyldithiocarbamato) nickel complexes may be employed.

Specific examples of the organic color fading preventing agents are described in the following patents or patent applications.

Hydroquinones: U.S. Pat. Nos, 2,360,290, 2,418,613, 2,700,453, 2,701,197, 2,728,659, 2,732,300, 2,735,765, 3,982,944 and 4,430,425, British Patent No. 1,363,921, U.S. Pat. Nos. 2,710,801 and 2,816,028, etc.; 6-hydroxychromanes, 5-hydroxycoumarans and spirochromanes: U.S. Pat. Nos. 3,432,300, 3,573,050, 3,574,627, 3,698,909 and 3,764,337, JP-A-52-152225, etc.; spiroindanes: U.S. Pat. No. 4,360,589, etc.; p-alkoxyphenols: U.S. Pat. No. 2,735,765, British Patent No. 2,066,975, JP-A-59-10539, JP-B-57-19764 (the term "JP-B" as used herein means an "examined Japanese patent publication") etc.; hindered phenols: U.S. Pat. No. 3,700,455, JP-A 52-72225, U.S. Pat. No. 4,228,235, JP-B-52-6623, etc.; gallic acid derivatives, methylenedioxybenzenes and aminophenols: U.S. Pat. Nos. 3,457,079 and 4,332,886, JP-B-56-21144, etc.; hindered amines: U.S. Pat. Nos. 3,336,135 and 4,268,593, British Patent Nos. 1,326,889, 1,354,313 and 1,410,846, JP-B-51-1420, JP-A-58-114036, JP-A-59-53846, JP-A-59-78344, etc.; ether or ester derivatives of phenolic hydroxy group: U.S. Pat. Nos. 4,155,765, 4,174,220, 4,254,216 and 4,264,720, JP-A-54-145530, JP-A-55-6321, JP-A-58-105147, JP-A-59-10539, JP-B-57-37856, U.S. Pat. No. 4,279,990, JP-B-53-3263, etc.

Further, specific examples of the metal complexes include those examples described in U.S. Pat. Nos. 4,050,938 and 4,241,155, and British Patent No. 2,027,731(A).

The color fading preventing agent is coemulsified with the corresponding color coupler in an amount of from 5 to 100% by weight of the color coupler and incorporated into the light-sensitive layer to achieve the effects thereof.

In order to prevent degradation of the cyan dye image due to heat, particularly due to light, it is effective to introduce an ultraviolet light absorbing agent to both layers adjacent to the cyan color forming layer.

Among the above described color fading preventing agents, spiroindanes and hindered amines are particularly preferred.

In accordance with the present invention, it is preferred to employ the compounds as described below together with the above described couplers, particularly pyrazoloazole couplers. More specifically, to employ individually or in combination a compound (A) which is capable of chemically bonding with the aromatic amine developing agent remaining after color development to give a chemically inactive and substantially colorless compound, and/or a compound (B) which is capable of chemically bonding with the oxidation product of the aromatic amine developing agent remaining after color development to give a chemically inactive and substantially colorless compound is preferred in view of preventing the occurrence of stain and other undesirable side-effects due to the formation of colored dye upon a reaction of the color developing agent or oxidation product thereof which remains in the photographic layer with the coupler during preservation of the photographic material after processing.

Among the compounds (A), those capable of reacting at a second order reaction rate constant $k_2$ (in trioctyl phosphate at 80° C.) with p-anisidine of from 1.0 liter/mol·sec. to $1\times10^{-5}$ liter/mol·sec. are preferred.

When the constant $k_2$ is larger than this range, the compounds per se are unstable and may be apt to react with gelatin or water to decompose. On the other hand, when the constant $k_2$ is smaller than the above described range, the reaction rate in the reaction with the remaining aromatic amine developing agent is low, and as a result, undesirable side-effects due to the remaining aromatic amine developing agent, are not prevented to a suitable degree, such prevention being the object of the use.

Of the Compounds (A), those more preferred are represented by the following general formula (AI) or (AII):

$$R_1\text{-}(A)_n\text{-}X \qquad \text{(AI)}$$

$$R_2\text{-}\underset{\underset{B}{|}}{C}=Y \qquad \text{(AII)}$$

wherein $R_1$ and $R_2$ each represents an aliphatic group, an aromatic group or a heterocyclic group; X represents a group which can react with the aromatic amine developing agent to split off; A represents a group which can react with the aromatic amine developing agent to form a chemical bond; n represents 0 or 1; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (AII); or $R_1$ and X, or Y and $R_2$ or B may combine with each other to form a cyclic structure.

Typical reactions for chemically bonding with the remaining aromatic amine developing agent, include a substitution reaction and an addition reaction.

Specific examples of the compounds represented by the general formulae (AI) or (AII) are described, for example, in Japanese Patent Application Nos. 62-158342, 62-158643, 62-212258, 62-214681, 62-228034 and 62-279843.

The color photographic light-sensitive material according to the present invention may contain an ultraviolet light absorbing agent in the hydrophilic colloid layer. Suitable examples of the ultraviolet light absorbing agents used include aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example, those described in U.S. Pat. Nos. 3,705,805 and 3,707,375), butadiene compounds (for example, those described in U.S. Pat. No. 4,045,229), and benzoxidol compounds (for example, those described in U.S. Pat. No. 3,700,455). Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Suitable binder or protective colloids which can be used for the emulsion layers of the color photographic light-sensitive material according to the present invention include, gelatin which is advantageously used, but other hydrophilic colloids can be used alone or together with gelatin.

Suitable types of gelatin include lime-treated gelatin and acid-treated gelatin for use in the present invention. Details of the production of gelatin are described in Arther Weiss, *The Macromolecular Chemistry of Gelatin,* published by Academic Press, 1964.

Suitable support for use in the present invention include supports that are conventionally employed in photographic light-sensitive materials, for example, cellulose nitrate films, cellulose acetate films, cellulose acetate butyrate films, cellulose acetate propionate films, polystyrene films, polyethylene terephthalate films, polycarbonate films, laminates of these films, thin glass films, and papers. Paper coated or laminated with baryta or an α-olefin polymer, in particular, a polymer of an α-olefin having 2 to 10 carbon atoms such as polyethylene, polypropylene or ethylene-butene copolymer, vinyl chloride resin containing a reflective material such as titatium dioxide, and a support such as a plastic film having a roughened surface for improving the adhesion with other polymers as described in JP-B-47-19068, give good results. Also, a resin hardenable by the irradiation of ultraviolet rays can be used.

Depending on the purpose of the color photographic light-sensitive material, a transparent support or an opaque support may be used. Also, a colored transparent support containing dyes or pigments can also be used.

Suitable opaque supports for use in the present invention, include papers which are opaque by themselves and transparent films which were opacified by the incorporation of dyes or pigments such as titanium oxide. Also, a plastic film surface-treated by the method as described in JP-B-47-19068 can be used.

A subbing layer is usually provided on a support. Furthermore, for improving the adhesive property, a pretreatment such as a corona discharging treatment, ultraviolet irradiation treatment, or flame treatment may be applied to the surface of the support.

The color photographic light-sensitive materials according to the present invention which are utilized to prepare color photographs are suitable for use as conventional color photographic materials, for example, color negative films, color paper, color reversal paper, and color reversal films, particularly color photographic light-sensitive materials for printing.

For development processing of the color photographic light-sensitive materials according to the present invention, a black-and-white developing solution and/or a color developing solution is employed.

Suitable color developing solutions for use in the present invention include an alkaline aqueous solution preferably containing an aromatic primary amine type color developing agent as the main component. As the color developing agent, while an aminophenol type compound is useful, a p-phenylene-diamine type compound is preferably employed. Typical examples of p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfate, hydrochloride, and p-toluenesulfonate thereof.

Two or more kinds of color developing agents may be employed in a combination thereof, depending on the purpose.

The color developing solution can ordinarily contain a pH buffering agent such as carbonates, borates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, phenylsemicarbazides, triethanolamine, catechol sulfonic acids, or triethylenediamine(1,4-diazabicyclo[2,2,2]octane) compounds; organic solvents such as ethylene glycol, or diethylene glycol; development accelerators such as benzyl alcohol, polyethylene glycol, quarternay ammonium salts, or amines; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid), and salts thereof.

In the case of conducting reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazoldione, or aminophenols such as N-methyl-p-aminophenol may be employed individually or in a combination.

The pH of the color developing solution or the black-and-white developing solution is usually in a range of from 9 to 12. Further, the amount of replenishment for the developing solution can be varied depending to color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and aerial oxidation of the processing solution by means of reducing the area of the processing tank which is in contact with the air. Further, the amount of replenishment can be reduced using a means to restrain the accumulation of bromide ion in the developing solution.

After color development, the photographic emulsion layers are usually subjected to bleach processing. The bleach processing can be performed simultaneously with a fix processing (bleach-fix processing), or it can be performed independently from the fix processing. Further, for the purpose of rapid processing, a processing method wherein a bleach-fix processing is conducted after a bleach processing may be employed. Moreover, depending on the purpose, it may be appropriate to carry out a process using a continuous two tanks for bleaching and fixing, to carry out fix processing before bleach-fix processing, or to conduct bleach processing after bleach-fix processing.

Examples of bleaching agents which can be employed in the bleach processing or bleach-fix processing include compounds of multivalent metals such as iron(III), cobalt(III), chromium(VI), and copper(II); peracids; quinones; and nitro compounds. Representative examples of the bleaching agents include ferricyanides; dichloromates; organic complex salts of iron(III) and cobalt(III), for example, complex salts of aminopolycarboxylic acids (such as ethylenediaminetetraacetic acid, diethylenetriamine-pentaacetic acid, cyclohexane diaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by iron (III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron (III) complex salt of aminopolycarboxylic acid is usually in a range of from 5.5 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide group as described, for example, in U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A 53-141623, JP-A-53-28426, and *Research Disclosure,* No. 17129 (July 1978); thiazolidine derivatives as described, for example, in JP-A-50-140129; thiourea derivatives as described, for example, in JP-B-45-8506, JP-A-52-20832, JP-A-53-32735 and U.S. Pat. No. 3,706,561; iodides as described, for example, in West German Patent No. 1,127,715 and JP-A-58-16235; polyoxyethylene compounds as described, for example, in West German Patent Nos. 966,410 and 2,748,430; polyamine compounds as described, for example, in JP-B-45-8836; compounds as described, for example, in JP-A-49-42434, JP-A-49-59644, JP-A-53-94927, JP-A-54-35727, JP-A-55-26506 and JP-A-58-163940; and bromide ions. Of these compounds, the compounds having a mercapto group or a disulfide bond are preferred in view of their large bleach accelerating effects. Particularly, the compounds as described in U.S. Pat. No. 3,893,858, West German Patent No. 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

Fixing agents which can be employed in the fixing solution or the bleach-fixing solution, include thiosulfates, thiocyanate, thioether compounds, thioureas, or a large amount of iodide. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on characteristics of photographic light-sensitive materials (due to elements used therein, for example, couplers), uses thereof, temperature of washing water, the number of water washing tanks (stages), the replenishment system such as countercurrent or orderly current, or other various conditions. The relationship between the number of water washing tanks and the amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, the staying time of water in a tank is increased and thus causes propagation of bacteria and some problems including, for example, adhesion of floatage formed on the photographic materials. The method of processing silver halide color photographic materials according to the present invention, can include a method for reducing the amount of calcium ions and magnesium ions as described in JP-A-62-288838 to effectively solve the above problems. Further, sterilizers, for example, isothiazolone compounds as described in JP-A-57-8542, cyabendazoles, chlorinated type sterilizers such as sodium chloroisocyanurate, benzotriazoles, and sterilizers as described in Hiroshi Horiguchi, *Bokin-Bobaizai No Kaqaku, Biseibutsu No Mekkin-, Sakkin-, Bobai-Gijutsu,* edited by Eiseigijutsu Kai, and *Bokin-Bobaizai Jiten,* edited by Nippon Bokin-Bobai Gakkai can be employed.

The pH of the washing water used in the processing of the photographic light-sensitive materials according to the present invention is usually from 4 to 9, preferably from 5 to 8. The temperature of washing water and the time for a water washing step can be variously set depending on the characteristics or uses of the photographic light-sensitive materials. However, generally a suitable temperature range is of from 15° C. to 45° C. and a suitable time period is from 20 sec. to 10 min., and a range of from 25° C. to 40° C. and a period from 30 sec. to 5 min. is preferable.

The photographic light-sensitive material of the present invention can also be directly processed with a stabilizing solution in place of the above-described water washing step. In such a stabilizing process, any of known methods as described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing formulin and a surface active agent, which is employed as a final bath in the processing of color photographic light-sensitive materials for photographing. To such a stabilizing bath, various chelating agents and antimold agents may also be added.

Overflow solutions resulted from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of precursors of developing agents include indoaniline type compounds as described in U.S. Pat. No. 3,342,597, Schiff's base type compounds as described in U.S. Pat. No. 3,342,599 and *Research Disclosure,* No. 14850 and ibid. No. 15159, aldol compounds as described in *Research Discosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of these compounds include those as described, for example, in JP-A-56-64339, JP-A-57-144547, and JP-A-58-115438.

In the present invention, various kinds of processing solutions can be employed in a temperature range from 10° C. to 50° C. Although a standard temperature range is from 33° C. to 38° C., it is possible to carry out the processing at higher temperatures in order to accelerate the processing whereby the processing time is shortened, or contrary at lower temperatures in order to improve the image quality and to maintain stability of the processing solutions.

Further, for the purpose of saving an amount of silver employed in the color photographic light-sensitive material, the photographic processing may be conducted utilizing cobalt or hydrogen peroxide intensification as described in West German Patent No. 2,226,770 or U.S. Pat. No. 3,674,499.

In accordance with the present invention, color photographs exhibiting excellent sensitivity and color forming properties, and, in which color fading of the cyan image is restrained even when processed with an exhausted bleach-fixing solution and, whereby the color balance of cyan, magenta and yellow images is well maintained in the case of preservation for a long period of time, are obtained.

The present invention will be explained in greater detail with reference to the following examples, but the present invention should not be construed as being limited thereto.

EXAMPLE 1

On a paper support, both surfaces of which were laminated with polyethylene, layers as shown below were coated in order to prepare a multilayer silver halide photographic material which was designated Sample 101. For the coupler solvent below, ethyl acetate was used as an auxiliary solvent together with a solvent having a high boiling point.

Construction of Layers

The composition of the layers are described below. The coated amounts are indicated in terms of g/m$^2$ provided that the coated amounts of the silver halide emulsions are indicated in terms of g silver/m$^2$.

Support:

Polyethylene laminated paper in which the polyethylene on the first layer side contained a white pigment ($TiO_2$) and a blueish dye.

| | |
|---|---|
| First Layer: Blue-sensitive Layer | |
| Monodispersed silver chlorobromide emulsion (EM1) spectrally sensitized with Sensitizing dye (ExS-1) | 0.16 |
| Monodispersed silver chlorobromide emulsion (EM2) spectrally sensitized with Sensitizing dye (ExS-1) | 0.10 |
| Gelatin | 1.86 |
| Color image stabilizer (Cpd-1) | 0.02 |
| Polymer (poly-1) | 0.08 |
| Yellow coupler (ExY) | 0.83 |
| Solvent (Solv-1/Solv-2 = 1:1 by volume ratio) | 0.35 |
| Second Layer: Color-mixing Preventing Layer | |
| Gelatin | 0.99 |
| Color mixing preventing agent (Cpd-3) | 0.03 |
| Solvent (Solv-3) | 0.06 |
| Third Layer: Green-sensitive Layer | |
| Monodispersed silver chlorobromide emulsion (EM3) spectrally sensitized with Sensitizing dyes (ExS-2, 3) | 0.05 |
| Monodispersed silver chlorobromide emulsion (EM4) spectrally sensitized with Sensitizing dyes (ExS-2, 3) | 0.11 |
| Gelatin | 1.80 |
| Magenta coupler (ExM) | 0.39 |
| Color image stabilizer (Cpd-4) | 0.20 |
| Color image stabilizer (Cpd-5) | 0.05 |
| Color image stabilizer (Cpd-6) | 0.04 |
| Gradation controlling agent (Cpd-15) | 0.01 |

-continued

| | |
|---|---|
| Solvent (Solv-3) | 0.12 |
| Solvent (Solv-4) | 0.25 |
| Fourth Layer: Ultraviolet Light Absorbing Layer | |
| Gelatin | 1.60 |
| Ultraviolet light absorbing agent (Cpd-7/Cpd-8/Cpd-9 = 3/2/6 by weight ratio) | 0.70 |
| Color mixing preventing agent (Cpd-3) | 0.05 |
| Solvent (Solv-5) | 0.27 |
| Fifth Layer: Red-sensitive Layer | |
| Monodispersed silver chlorobromide emulsion (EM5) spectrally sensitized with Sensitizing dyes (ExS-4, 5) | 0.07 |
| Monodispersed silver chlorobromide emulsion (EM6) spectrally sensitized with Sensitizing dyes (ExS-4, 5) | 0.16 |
| Gelatin | 0.92 |
| Cyan coupler (Compound I-1) | 0.17 |
| Cyan coupler (Compound II-1) | 0.21 |
| Color image stabilizer (Cpd-1) | 0.03 |
| Color image stabilizer (Cpd-5) | 0.01 |
| Color image stabilizer (Cpd-6) | 0.01 |
| Ultraviolet light absorbing agent (Cpd-7/Cpd-9/Cpd-10 = 2/4/5 by weight ratio) | 0.17 |
| Gradation controlling agent (Cpd-16) | 0.02 |
| Solvent (Solv-2) | 0.20 |
| Polymer (poly-1) | 0.30 |
| Sixth Layer: Ultraviolet Light Absorbing Layer | |
| Gelatin | 0.54 |
| Ultraviolet light absorbing agent (Cpd-7/Cpd-8/Cpd-9 = 1/5/3 by weight ratio) | 0.21 |
| Color mixing preventing agent (Cpd-3) | 0.02 |
| Solvent (Solv-5) | 0.08 |
| Seventh Layer: Protective Layer | |
| Gelatin | 1.33 |
| Acryl-modified polyvinyl alcohol copolymer (modification degree: 17%) | 0.17 |
| Liquid paraffin | 0.03 |

Cpd-11 and Cpd-12 were used as irradiation presenting dyes.

To each of the layers, Alkanol XC (Du Pont Co.), sodium alkylbenzenesulfonate, succinic acid ester, and Megafac F-120 (Dai Nippon Ink and Chemical Co., Ltd.) were used as an emulsifying dispersing agent and a coating aid.

For stabilizing silver halide, Cpd-13 and Cpd-14 were used.

Further, to each of the layers, 1-oxy-3,5-dichloro-s-triazine sodium salt was used as a gelatin hardener, and Cpd-2 was used as a viscosity imparting agent.

The silver halide emulsions used are described in detail below.

| Emulsion | Crystal Form | Average Grain size (μm) | Bromide content (mol %) | Coefficient* of variation |
|---|---|---|---|---|
| EM1 | cubic | 0.96 | 80 | 0.06 |
| EM2 | " | 0.64 | 80 | 0.07 |
| EM3 | " | 0.52 | 70 | 0.08 |
| EM4 | " | 0.40 | 70 | 0.09 |
| EM5 | " | 0.44 | 70 | 0.09 |
| EM6 | " | 0.36 | 70 | 0.08 |

*Coefficient of variation = standard derivation/average grain size

The compounds used in the above-described layers are illustrated below.

ExS-1
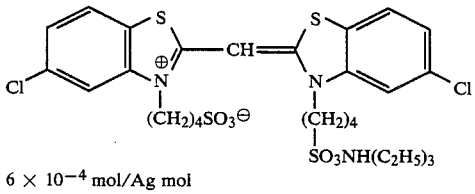
$6 \times 10^{-4}$ mol/Ag mol
ExS-2
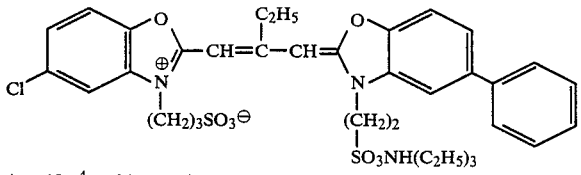
$4 \times 10^{-4}$ mol/Ag mol
ExS-3
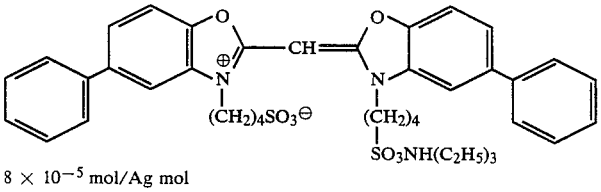
$8 \times 10^{-5}$ mol/Ag mol
ExS-4
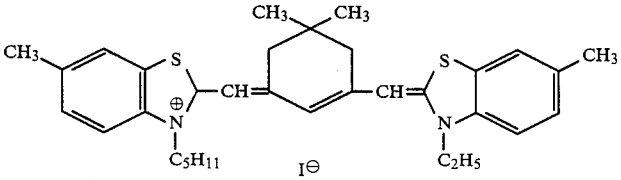
$1.8 \times 10^{-4}$ mol/Ag mol
ExS-5
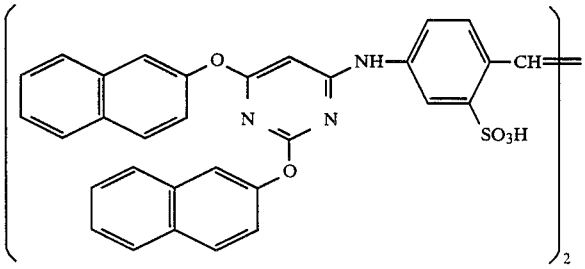
Cpd-1
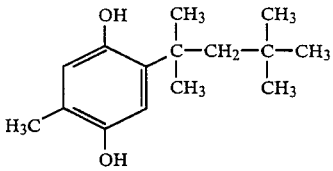
Cpd-2
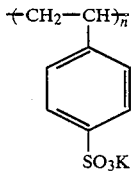
Cpd-3
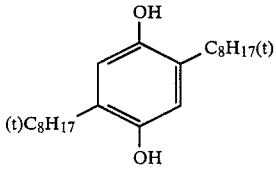

-continued
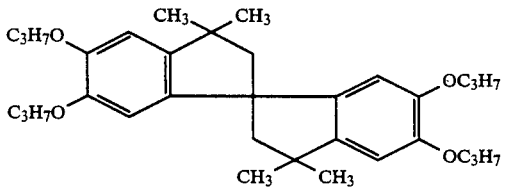
Cpd-4
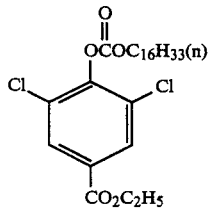
Cpd-5
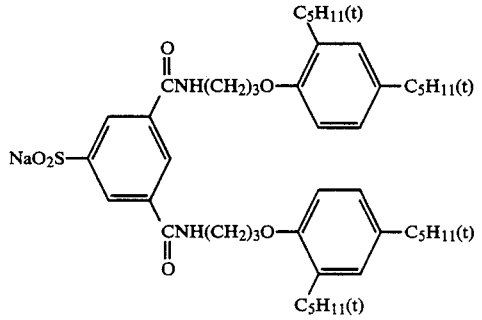
Cpd-6
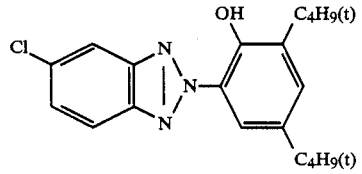
Cpd-7
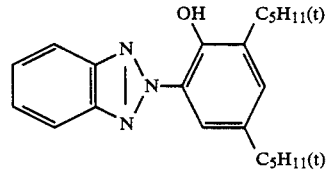
Cpd-8
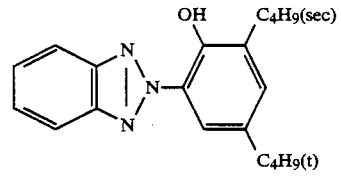
Cpd-9
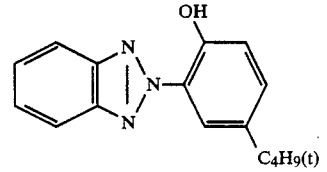
Cpd-10

-continued
Cpd-11
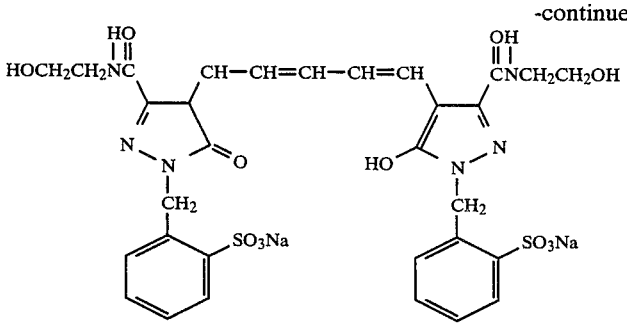
Cpd-12
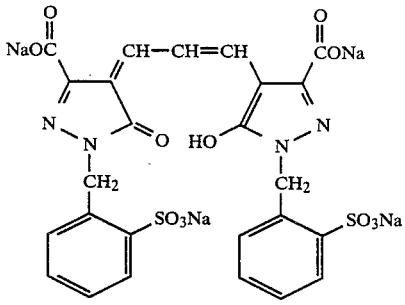
Cpd-13
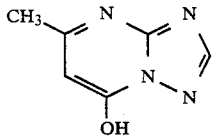
Cpd-14
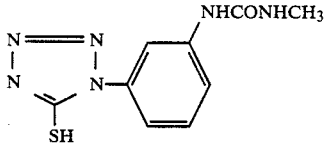
Cpd-15
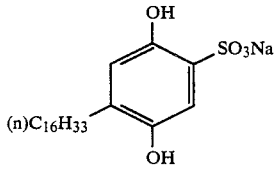
Cpd-16
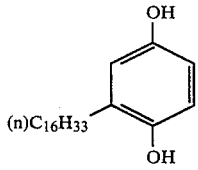
Solv-1
$((iso)C_9H_{19}O)_3P{=}O$
Solv-2
$C_8H_{17}\underset{\underset{O}{\backslash\,/}}{CHCH}(CH_2)_7COOC_8H_{17}$
Solv-3
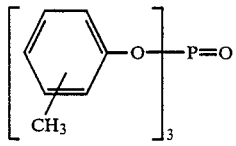
Solv-4
$(C_4H_9\underset{\underset{C_2H_5}{|}}{C}HCH_2O)_3P{=}O$ -continued

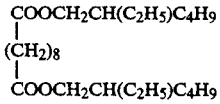

Solv-5

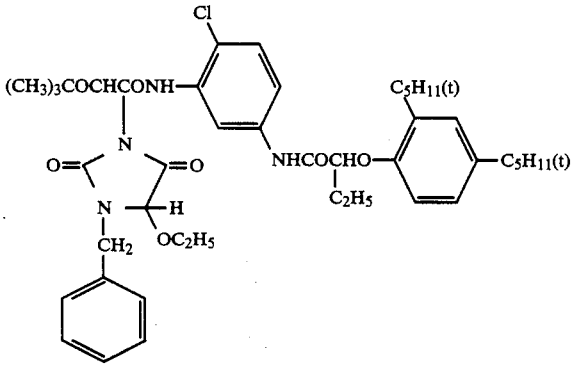

(ExY)

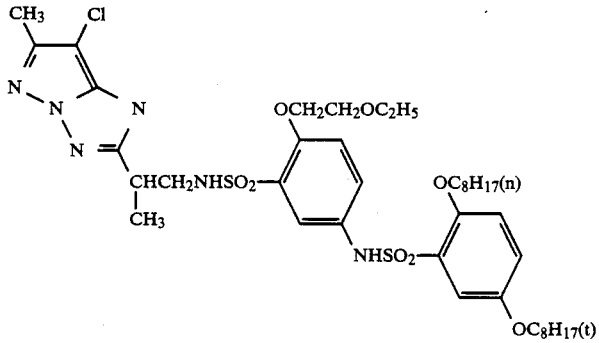

(ExM)

Poly(N-tert-butylacrylamide)
(molecular weight: 80,000)

(poly-1)

Samples 102 to 115 were prepared in the same manner as described for Sample 101 except that the cyan couplers used in Sample 101 in the red-sensitive layer were changed to those shown in Table 1 below.

The total mole number of cyan couplers represented by the general formula (I) or (II) in each of Samples 102 to 115 were the equimolar to that of (I-1) and (II-1) in Sample 101.

TABLE 1

| Sample No. | Cyan Coupler (I) | (II) | (I)/(I) + (II) (molar ratio) |
|---|---|---|---|
| 101 (Present invention) | I-1 | II-1 | 0.5 |
| 102 (Present invention) | I-2 | II-1 | 0.5 |
| 103 (Present invention) | I-3 | II-1 | 0.5 |
| 104 (Present invention) | I-5 | II-1 | 0.5 |
| 105 (Present invention) | I-1 | II-2 | 0.5 |
| 106 (Present invention) | I-2 | II-2 | 0.5 |
| 107 (Present invention) | I-2 | II-3 | 0.5 |
| 108 (Present invention) | I-2 | II-2 | 0.3 |
| 109 (Present invention) | I-2 | II-2 | 0.6 |
| 110 (Comparison) | I-1 | — | 1 |
| 111 (Comparison) | I-2 | — | 1 |
| 112 (Comparison) | I-3 | — | 1 |
| 113 (Comparison) | — | II-1 | 0 |
| 114 (Comparison) | — | II-2 | 0 |
| 115 (Comparison) | — | II-3 | 0 |

The color photographic light-sensitive materials thus-prepared were imagewise exposed to light and processed according to the processing steps shown below using a Fuji Color Paper Processor PP600.

| Processing Step | Temperature (°C.) | Time |
|---|---|---|
| Color Development | 38 | 1 min. 40 sec. |
| Bleach-Fixing | 33 | 60 sec. |
| Rinse (1) | 30 to 34 | 20 sec. |
| Rinse (2) | 30 to 34 | 20 sec. |
| Rinse (3) | 30 to 34 | 20 sec. |
| Drying | 70 to 80 | 50 sec. |

The rinse steps were conducted using a three-tank countercurrent system from Rinse (3) to Rinse (1).

The composition of each processing solution used was as follows:

| Color Developing Solution | |
|---|---|
| Water | 800 ml |
| Diethylenetriaminepentaacetic acid | 1.0 g |
| Nitrilotriacetic acid | 2.0 g |
| 1-Hydroxyethylidene-1,1-diphosphonic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 2.0 g |
| Fluorescent whitening agent (WHITEX 4B, manufactured by | 1.5 g |

-continued

| | |
|---|---|
| Sumitomo Chemical Co., Ltd.) | |
| Water to make | 1,000 ml |
| pH at 25° C. | 10.20 |
| Bleach-Fixing Solution | |
| Water | 400 ml |
| Ammonium thiosulfate (70% aqueous solution) | 200 ml |
| Sodium sulfite | 20 g |
| Ammonium iron (III) ethylenediamine-tetraacetate | 60 g |
| Disodium ethylenediaminetetraacetate | 5 g |
| Water to make | 1,000 ml |
| pH at 25° C. | 6.70 |

Rinse Solution

Ion exchange water (contents of calcium and magnesium each being not more than 3 ppm).

With the cyan color images thus-obtained, photographic characteristics were measured. The results are shown in Table 2 below.

TABLE 2

| Sample No. | Relative Sensitivity | Maximum Density |
|---|---|---|
| 101 (Present Invention) | 99 | 2.47 |
| 102 (Present Invention) | 100 | 2.47 |
| 103 (Present Invention) | 100 | 2.46 |
| 104 (Present Invention) | 100 | 2.46 |
| 105 (Present Invention) | 99 | 2.46 |
| 106 (Present Invention) | 99 | 2.46 |
| 107 (Present Invention) | 100 | 2.45 |
| 108 (Present Invention) | 100 | 2.45 |
| 109 (Present Invention) | 100 | 2.45 |
| 110 (Comparison) | 94 | 2.47 |
| 111 (Comparison) | 93 | 2.47 |
| 112 (Comparison) | 92 | 2.46 |
| 113 (Comparison) | 93 | 2.23 |
| 114 (Comparison) | 92 | 2.23 |
| 115 (Comparison) | 91 | 2.21 |

It can be seen from the results shown in Table 2 that the samples according to the present invention exhibit excellent sensitivity and color forming properties.

The reason why the relative sensitivity is low in the sample for comparison using Coupler (I) or Coupler (II) singly is not completely clear, but it is supposed as follows.

It is believed that in case of using Coupler (I), sensitizing dyes adsorbed on silver halide grains are desorbed by the couplers in the coating solution and thus the spectral sensitivity of the emulsion decreases. On the other hand, with respect to Coupler (II), it is believed that the low color forming property of the coupler is due to low activity thereof and results in the low color forming property. On the contrary, by the combined use of the couplers according to the present invention, the above described problems are synergistically reduced for some reason.

EXAMPLE 2

Samples 201 to 215 were prepared in the same manner as described in Samples 101 to 115 of Example 1 except that the silver halide emulsions described below were used in place of those used in Samples 101 to 115, respectively. More specifically, EM-1 and EM-2 were changed to EM-7, EM-3 and EM-4 were changed to EM-8, and EM-5 and EM-6 were changed to EM-9.

The silver halide emulsions used in this example are described in detail below.

| Emulsion | Crystal Form | Average Grain size (μm) | Bromide content (mol %) | Coefficient* of variation |
|---|---|---|---|---|
| EM7 | cubic | 0.85 | 0.6 | 0.10 |
| EM8 | " | 0.45 | 1.0 | 0.09 |
| EM9 | " | 0.34 | 1.8 | 0.10 |

*Coefficient of variation = standard derivation/average grain size

The color photographic light-sensitive materials thus-prepared were exposed to light through an optical wedge and then processed according to the processing steps described below.

| Processing Step | Temperature | Time |
|---|---|---|
| Color Development | 35° C. | 45 sec |
| Bleach-Fixing | 30 to 36° C. | 45 sec |
| Stabilizing (1) | 30 to 37° C. | 20 sec |
| Stabilizing (2) | 30 to 37° C. | 20 sec |
| Stabilizing (3) | 30 to 37° C. | 20 sec |
| Stabilizing (4) | 30 to 37° C. | 30 sec |
| Drying | 70 to 85° C. | 60 sec |

The stabilizing steps were conducted using a four-tank countercurrent system from Stabilizing step (4) to Stabilizing step (1).

The composition of each processing solution used was as follows:

| | |
|---|---|
| Color Developing Solution | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Fluorescent brightening agent (4,4-diaminostilbene type) | 2.0 g |
| Water to make | 1000 ml |
| pH (25° C.) | 10.10 |
| Bleach-Fixing Solution | |
| Water | 400 ml |
| Ammonium thiosulfate (70% aqueous solution) | 100 ml |
| Sodium sulfite | 18 g |
| Ammonium ethylenediaminetetraacetate iron (III) | 55 g |
| Disodium ethylenediaminetetraacetate | 3 g |
| Glacial acetic acid | 8 g |
| Water to make | 1000 ml |
| pH (25° C.) | 5.5 |
| Stabilizing Solution | |
| Formalin (37% aqueous solution) | 0.1 g |
| Formaldehyde-sulfite adduct | 0.7 g |
| 5-Chloro-2-methyl-4-isothiazolin-3-one | 0.02 g |
| 2-Methyl-4-isothiazolin-3-one | 0.01 |
| Cupric sulfate | 0.005 g |
| Water to make | 1000 ml |
| pH (25° C.) | 4.0 |

Further, using a bleach-fixing solution having the composition shown below, as an exhausted bleach-fixing solution, the same development processing as described above was conducted in order to evaluate the color fading property of cyan dye in the case of processing with the exhausted bleach-fixing solution.

| Composition of Exhausted Bleach-Fixing Solution: | |
|---|---|
| Water | 400 ml |
| Ammonium thiosulfate (70% aqueous solution) | 100 ml |
| Sodium sulfite | 18 g |
| Ammonium ethylenediaminetetraacetate iron (III) | 55 g |
| Disodium ethylenediaminetetraacetate | 3 g |
| Glacial acetic acid | 8 g |
| Hydrosulfite | 3 g |
| Water to make | 1000 ml |
| pH (25° C.) after adjustment | 5.5 |

With the samples thus-processed, the maximum reflective density of cyan dye was measured and a remaining rate of dye was determined. The results thus obtained are shown in Table 3 below. The remaining rate of dye at the maximum density area was determined by the following equation:

$$\text{Remaining Rate of Dye} = \frac{\text{Cyan Maximum Density Obtained by Processing with Exhausted Bleach-Fixing solution}}{\text{Cyan Maximum Density Obtained by Processing with Fresh Bleach-Fixing Solution}} \times 100$$

TABLE 3

| Sample No. | Remaining Rate of Dye | Remark |
|---|---|---|
| 201 | 97 | Present Invention |
| 202 | 98 | " |
| 203 | 98 | " |
| 204 | 98 | " |
| 205 | 98 | " |
| 206 | 97 | " |
| 207 | 97 | " |
| 208 | 97 | " |
| 209 | 98 | " |
| 210 | 82 | Comparison |
| 211 | 85 | " |
| 212 | 87 | " |
| 213 | 98 | " |
| 214 | 98 | " |
| 215 | 98 | " |

From the results shown in Table 3 it is apparent that in the samples according to the present invention, the color fading of cyan dye obtained by processing with the exhausted bleach-fixing solution is hardly observed in spite of employing Coupler (I) which is apt to cause color fading.

Further, heat fastness and light fastness of each sample thus-processed were evaluated in the following manner. More specifically, each of the samples was stored in a dark place at 100° C. for 7 days (heat fastness), or irradiated to light in a xenon fade meter (80,000 lux) for 7 days (light-fastness). Then, the rate of decrease in density in the area of the sample having an initial density of 1.5 was determined. The results thus obtained are shown in Table 4 and Table 5 below.

TABLE 4

| Sample No. | Layer | Color Image Fastness 100° C., 7 Days (%) | Color Image Fastness Xenon, 7 Days (%) | Remark |
|---|---|---|---|---|
| 201 | R | 14 | 18 | Present Invention |
| 202 | R | 13 | 17 | Present Invention |
| 203 | R | 14 | 18 | Present Invention |

TABLE 4-continued

| Sample No. | Layer | Color Image Fastness 100° C., 7 Days (%) | Color Image Fastness Xenon, 7 Days (%) | Remark |
|---|---|---|---|---|
| 204 | R | 15 | 17 | Present Invention |
| 205 | R | 16 | 19 | Present Invention |
| 206 | R | 15 | 18 | Present Invention |
| 207 | R | 14 | 18 | Present Invention |
| 208 | R | 14 | 18 | Present Invention |
| 209 | R | 15 | 17 | Present Invention |
| 210 | R | 21 | 15 | Comparison |
| 211 | R | 20 | 15 | " |
| 212 | R | 20 | 14 | " |
| 213 | R | 12 | 23 | " |
| 214 | R | 13 | 23 | " |
| 215 | R | 13 | 24 | " |

TABLE 5

| Sample No. | Layer | Color Image Fastness 100° C., 7 Days (%) | Color Image Fastness Xenon, 7 Days (%) |
|---|---|---|---|
| 201 to 215 | B | 4–6 | 17–18 |
| | G | 5–6 | 16–18 |

As is apparent from the results shown in Table 4 and Table 5, the samples according to the present invention are excellent in color fading balance of yellow, magenta and cyan color which is extremely important in practical use.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one silver halide emulsion layer, wherein the silver halide color photographic material contains at least one cyan coupler represented by the general formula (I) described below and at least one cyan coupler represented by the general formula (II) described below

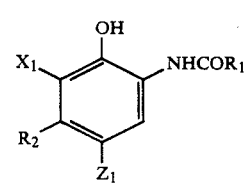

(I)

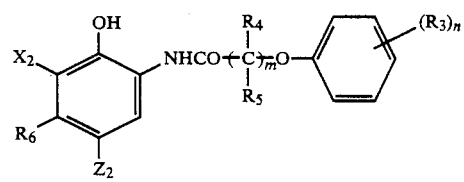

(II)

wherein $R_1$ represents a substituted or unsubstituted alkyl group having at least 8 carbon atoms, and when $R_1$ is a substituted alkyl group, the substituent of $R_1$ is selected from the group consisting of an alkyl group, an aryl group, an alkoxy, a carboxy group, an alkylcarbonyl group, an arylcarbonyl group, an alkoxycarbony group, an aryloxycarbonyl group, an acyloxy group, a sulfamoyl group, a carbamoyl group, a sulfonamide group, an acylamino group, an imido group, a sulfonyl group, a hydroxy group, a cyano group, a nitro group and a halogen atom; $R_2$ and $R_6$ each represents an alkyl group having from 2 to 4 carbon atoms; $R_3$ represents an alkyl group, an aryl group, a halogen atom, an alkoxy group, a hydroxy group, an acyloxy group or an alkoxycarbonyloxy group; n represents an integer of from 1 to 5, when n is 2 or more, two or more $R_3$'s are the same or different; $R_4$ represents a hydrogen atom or an alkyl group having not more than 16 carbon atoms; $R_5$ represents a hydrogen atom or an alkyl group having not more than 4 carbon atoms; m represents an integer of from 1 to 4; $X_1$ and $X_2$ each represents a hydrogen atom, a halogen atom, an alkyl group, an alkoxy group or an acylamino group; and $Z_1$ and $Z_2$ each represents a hydrogen atom or a group capable of being released upon a coupling reaction with a developing agent.

2. A silver halide color photographic light-sensitive material as claimed in claim 1, wherein the alkyl group represented by $R_3$ has not more than 20 carbon atoms.

3. A silver halide color photographic light-sensitive material as claimed in claim 1, wherein the group capable of being released upon a coupling reaction represented by $Z_1$ or $Z_2$ is a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group, N-heterocyclic group, or an aromatic azo group.

4. A silver halide color photographic light-sensitive material as claimed in claim 1, wherein the group capable of being released upon a coupling reaction represented by $Z_1$ or $Z_2$ has a photographically useful group.

5. A silver halide color photographic light-sensitive material as claimed in claim 1, wherein $X_1$ and $X_2$ each represents a halogen atom.

6. A silver halide color photographic light-sensitive material as claimed in claim 1, wherein $R_5$ is a hydrogen atom.

7. A silver halide color photographic light-sensitive material as claimed in claim 1, wherein m is 1.

8. A silver halide color photographic light-sensitive material as claimed in claim 1, wherein n is 1 or 2.

9. A silver halide color photographic light-sensitive material as claimed in claim 1, wherein $Z_1$ and $Z_2$ each represents a hydrogen atom or a halogen atom.

10. A silver halide color photographic light-sensitive material as claimed in claim 1, wherein any of $R_2$, $R_3$, $R_4$, $R_5$ and $R_6$ can represent a substituted group, and the substituent of $R_2$, $R_3$, $R_4$, $R_5$, and $R_6$ is selected from the group consisting of an alkyl group, an aryl group, an alkoxy, an aryloxy group, a carboxy group, an alkylcarbonyl group, an arylcarbonyl group, alkoxycarbonyl group, an aryloxycarbonyl group, an acyloxy group, a sulfamoyl group, a carbamoyl group, a sulfonamido group, an acylamino group, an imido group, a sulfonyl group, a hydroxy group, a cyano group, a nitro group and a halogen atom.

11. A silver halide color photographic light-sensitive material as claimed in claim 9, wherein $Z_1$ and $Z_2$ each represents a halogen atom.

12. A silver halide color photographic light-sensitive material as claimed in claim 1, wherein $R_2$ and $R_6$ each represents an ethyl group.

13. A silver halide color photographic light-sensitive material as claimed in claim 1, wherein $R_1$ has from 8 to 21 carbon atoms.

14. A silver halide color photographic light-sensitived material as claimed in claim 1, wherein the alkyl group represented by $R_1$ is a straight chain or branched chain alkyl group.

15. A silver halide color photographic light-sensitive material as claimed in claim 1, wherein $R_4$ is an alkyl group having not more than 12 carbon atoms.

16. A silver halide color photographic light-sensitive material as claimed in claim 15, wherein $R_5$ is a hydrogen atom and m is 1.

17. A silver halide color photographic light-sensitive material as claimed in claim 1, wherein $R_4$ and $R_5$ are hydrogen atoms and m is an integer of from 2 to 4.

18. A silver halide color photographic light-sensitive material as claimed in claim 1, wherein a molar ratio of the cyan coupler represented by the general formula (I) to the cyan coupler represented by the general formula (II) is from 0.05 to 20.

19. A silver halide color photographic light-sensitive material as claimed in claim 1, wherein the total amount of cyan couplers represented by formula (I) or (II) is from 0.1 to 1 mol per mol of silver.

20. A silver halide color photographic light sensitive material as claimed in claim 1, wherein said cyan coupler represented by the general formula (I) and the cyan coupler represented by the general formula (II) are present in at least one red-sensitive silver halide emulsion layer.

21. A silver halide color photographic light-sensitive material as claimed in claim 20, wherein said color photographic material further comprises at least one green-sensitive silver halide emulsion layer and at least one blue-sensitive silver halide emulsion layer.

22. A silver halide color photographic light-sensitive material as claimed in claim 1, wherein silver halide in said silver halide photographic emulsion layer is silver chlorobromide or silver chloride.

23. A silver halide color photographic light-sensitive material as claimed in claim 1, wherein a silver halide emulsion in said silver halide photographic emulsion layer is silver chlorobromide containing silver chloride in an amount of from 98 to 99.9 mol %.

* * * * *